US008041059B2

(12) United States Patent
Miyazaki

(10) Patent No.: US 8,041,059 B2
(45) Date of Patent: Oct. 18, 2011

(54) ELECTROSTATIC TRANSDUCER, ULTRASONIC SPEAKER, DRIVING CIRCUIT OF CAPACITIVE LOAD, METHOD OF SETTING CIRCUIT CONSTANT, DISPLAY DEVICE, AND DIRECTIONAL SOUND SYSTEM

(75) Inventor: Shinichi Miyazaki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 1337 days.

(21) Appl. No.: 11/562,900

(22) Filed: Nov. 22, 2006

(65) Prior Publication Data

US 2007/0121970 A1 May 31, 2007

(30) Foreign Application Priority Data

Nov. 25, 2005 (JP) ..... 2005-339779
Aug. 28, 2006 (JP) ..... 2006-230973

(51) Int. Cl.
*H04R 25/00* (2006.01)
*H04R 3/00* (2006.01)

(52) U.S. Cl. ..... 381/191; 381/116

(58) Field of Classification Search ..... 381/77, 381/113, 116, 174, 191
See application file for complete search history.

(56) References Cited

U.S. PATENT DOCUMENTS

| | | | | |
|---|---|---|---|---|
| 7,244,007 | B2 * | 7/2007 | Ishizaki | 347/5 |
| 7,319,763 | B2 * | 1/2008 | Bank et al. | 381/77 |
| 2003/0091200 | A1 * | 5/2003 | Pompei | 381/77 |

FOREIGN PATENT DOCUMENTS

| | | | |
|---|---|---|---|
| JP | 50-115517 | A | 9/1975 |
| JP | 61-124199 | U | 8/1986 |
| JP | 07-313937 | | 12/1995 |
| JP | 2000-050387 | | 2/2000 |
| JP | 2001-086587 | | 3/2001 |
| JP | 2001-086587 | A | 3/2001 |
| JP | 2002-158550 | | 5/2002 |
| JP | 2004-515091 | A | 5/2004 |
| JP | 2005-508105 | | 3/2005 |
| JP | 2005-510163 | | 4/2005 |
| JP | 2006-094158 | A | 4/2006 |
| WO | 0205588 | A2 | 1/2002 |

* cited by examiner

*Primary Examiner* — Brian Ensey
(74) *Attorney, Agent, or Firm* — Workman Nydegger

(57) ABSTRACT

An electrostatic transducer includes: a class-D power amplifier that amplifies an input signal; and a low pass filter that has a plurality of pairs of inductors and capacitors, is connected to an output side of the class-D power amplifier, and serves to eliminate switching carrier components included in an output of the class-D power amplifier. An electrostatic load capacitor of the electrostatic transducer serving as a driving load is disposed at a capacitor, which is closest to the output side of the class-D power amplifier, of circuit elements forming the low pass filter, an electrostatic coupling capacitor and an output transformer are interposed between the electrostatic load capacitor of the electrostatic transducer and an inductor closest to the output side of the class-D power amplifier of the low pass filter, and a damping resistor is connected in series to a primary coil of the output transformer.

10 Claims, 14 Drawing Sheets

EXAMPLE OF FREQUENCY CHARACTERISTIC OF OUTPUT VOLTAGE (LOAD TERMINAL VOLTAGE) OF CIRCUIT SHOWN IN FIG. 1

EQUIVALENT CIRCUIT OF OUTPUT CIRCUIT PORTION
(CAPACITIVE VALUE OF ELECTROSTATIC LOAD CAPACITOR IS CONVERTED TO CAUSE ELECTROSTATIC LOAD CAPACITOR TO BE INCLUDED IN PRIMARY SIDE OF TRANSFORMER)

EXAMPLES OF FREQUENCY CHARACTERISTICS OF OUTPUT VOLTAGE AND CIRCUIT INPUT CURRENT OF CIRCUIT SHOWN IN FIG. 3

FREQUENCY CHARACTERISTIC OF OUTPUT VOLTAGE (LOAD TERMINAL VOLTAGE) OF CIRCUIT SHOWN IN FIG. 1

EXAMPLE OF FREQUENCY CHARACTERISTIC OF LOSS OCCURRING IN DAMPING RESISTOR $R_D$

BASIC CONFIGURATION OF CLASS-D POWER AMPLIFIER

CONFIGURATION OF CLASS-D POWER AMPLIFIER
USING FOURTH-ORDER LC FILTER

LOSS OCCURRING IN DAMPING RESISTOR WHEN DIRECTLY DRIVING ELECTROSTATIC LOAD CAPACITOR WITH CLASS-D POWER AMPLIFIER AND LC FILTER

FREQUENCY CHARACTERISTIC OF OUTPUT VOLTAGE WHEN THERE IS NO LOAD RESISTOR $R_L$ SHOWN IN FIG. 12

ELECTROSTATIC TRANSDUCER, ULTRASONIC SPEAKER, DRIVING CIRCUIT OF CAPACITIVE LOAD, METHOD OF SETTING CIRCUIT CONSTANT, DISPLAY DEVICE, AND DIRECTIONAL SOUND SYSTEM

BACKGROUND

1. Technical Field

The present invention relates to an electrostatic transducer. In particular, the invention relates to an electrostatic transducer having a driving circuit, which is suitable for an electrostatic transducer that reproduces a sound having high directionality by outputting a modulated wave obtained by modulating a carrier wave in an ultrasonic band with a sound signal in an audible band, to a method of setting a circuit constant of the electrostatic transducer, to an ultrasonic speaker, to a display device having the ultrasonic speaker, to a directional sound system, and to a driving circuit of a capacitive load.

2. Related Art

An ultrasonic speaker can reproduce a sound having high directionality by outputting a modulated wave obtained by modulating a carrier wave in an ultrasonic band with a sound signal in an audible band. In general, a piezoelectric transducer is used as a transducer (transmitter) of the ultrasonic speaker. However, since the piezoelectric transducer uses a sharp resonance characteristic of an element, a frequency band thereof is very narrow even though high sound pressure can be obtained. As a result, in an ultrasonic speaker using the piezoelectric transducer, a reproducible frequency band is narrow, and accordingly, the reproduced sound quality tends to be poor as compared with a loudspeaker. For this reason, a variety of studies for improving the reproduced sound quality is being made (for example, refer to JP-A-2001-86587).

In addition, there is an ultrasonic speaker using an electrostatic transducer (refer to an example of an electrostatic transducer shown in FIGS. 6A to 6C) in which an electrostatic force is applied between an electrode of a vibrating film and a fixed electrode so as to vibrate the vibrating film and generate the sound pressure. The electrostatic transducer is characterized in that a flat output sound pressure characteristic can be obtained over a wide frequency range. Accordingly, in the ultrasonic speaker using an electrostatic transducer, the reproduced sound quality can be improved, as compared with the ultrasonic speaker using a piezoelectric transducer.

However, in the case of driving the electrostatic transducer in an analog amplifier, the following problems occur.

FIGS. 12A and 12B are views illustrating examples of a single end push-pull circuit. Referring to FIGS. 12A and 12B, it will be described about a difference between a case of driving a resistive load and a case of driving a capacitive load in a typical analog power amplifier. As shown in FIGS. 12A and 12B, the typical analog power amplifier uses a single end push-pull circuit in which an NPN transistor Tr1 and a PNP transistor Tr2 are totem-pole-connected to each other at an output stage (power amplification stage) in an up and down direction. An output-stage transistor is configured to operate in a class AB (class B) or a class A. In addition, FIG. 12A illustrates an example of the case of driving a load resistor $R_L$ serving as a resistive load, and FIG. 12B illustrates an example of the case of driving a load capacitor $C_L$ serving as a capacitive load.

FIGS. 13A and 13B are views illustrating examples of a power loss occurring in an output-stage transistor (one side) of an analog power amplifier. Specifically, FIGS. 13A and 13B illustrate the relationship between a collector current IC and a voltage VCE between a collector and an emitter of the upper transistor Tr1 shown in FIGS. 12A and 12B in the case when an output-stage transistor operates in a class B. In the case of the resistive load, the phase of an output voltage (load voltage) and the phase of an output current (load current) are approximately equal to each other, and accordingly, the collector current IC and the voltage VCE between the collector and the emitter of the transistor have an inverted relationship as shown in FIG. 13A. That is, the voltage VCE is a minimum when the output current IC is a maximum, and the voltage VCE is a maximum when the output current IC is a minimum.

In contrast, in the case of the load capacitor $C_L$, the phase of the output voltage (load voltage) and the phase of the output current (load current) are different from each other by 90°, and accordingly, the phase of the voltage VCE and the phase of the current IC are also different from each other by 90° as shown in FIG. 13B. At this time, when the output current IC is a maximum, the voltage VCE is not a minimum but is high, and thus a large loss WQ occurs in the transistor. As a result, a power loss larger than in the case of the resistive load occurs in the transistor.

As described above, when an electrostatic transducer is driven by the typical analog power amplifier, the power loss in the output-stage transistor is larger in the case of the capacitive load than the case of the resistive load assuming that output power is equal. Consequently, in the case when the electrostatic transducer is driven by the analog power amplifier, a power amplifier having an output higher than in the case of driving the resistive load is required, which causes a problem in that an apparatus becomes large.

On the other hand, in recent years, a class-D power amplifier that causes an output-stage transistor to switching-operate has come into wide use as an audio power amplifier (for example, refer to JP-A-2002-158550). The class-D power amplifier is characterized in that a power MOSFET having low on-resistance is used as an output-stage element and it is possible to reduce a loss in the output-stage element by performing a switching operation on the MOSFET. Since the loss in the output-stage element is small in the class-D power amplifier as compared with an analog amplifier, a radiator indispensable to the analog power amplifier may not be prepared or may be made small.

Therefore, it is possible to realize a small and high-output amplifier. For this reason, the class-D power amplifier is often adopted in an amplifier for a vehicle or an amplifier for a portable terminal, in which miniaturization and low loss is required, an AV amplifier having a large number of output channels, or the like.

FIG. 14 is a view illustrating an example of the configuration of a typical class-D power amplifier. In the class-D power amplifier 21 shown in FIG. 14, a PWM circuit 41 modulates an input signal 40 to a high-frequency digital signal by using a PWM (pulse width modulation) method or a PDM (pulse density modulation) method and then a gate driving circuit 42 drives a class-D output stage 43. In the class-D output stage 43, the power MOSFET having low on-resistance is used such that the power MOSFET operates in a saturated region, that is, performs a switching operation (ON/OFF operation), by means of the gate driving circuit 42. While the power MOSFET is in an OFF state, a current hardly flows, and accordingly, the loss in the power MOSFET is almost zero. On the other hand, while the power MOSFET is in an ON state, a current flows through a load; however, since a resistance of the power MOSFET being in the ON state, that is, a so-called ON resistance is so small as to be within a range of several to several tens of milliohms, the loss in the power MOSFET can be suppressed to be significantly small even if a large amount of current flows. Accordingly, since the loss occurring in an output-stage element is very small in the class-D power amplifier 21 as compared with an analog amplifier, it is possible to realize a small and high-output amplifier.

As described above, the output of the class-D output stage 43 is a switching wave (modulated wave), the output of the class-D output stage 43 needs to be supplied to a load after eliminating switching carrier components by the use of a low pass filter. As the low pass filter, an LC filter in which the power loss is small is generally used.

Here, a case in which a capacitive load such as an electrostatic transducer is driven by the class-D power amplifier will be considered. As described above, in order to eliminate the switching carrier components, an LC filter is inserted behind a class-D output stage in the class-D power amplifier. Here, a capacitor C, which is a part of the LC filter, may be replaced by an electrostatic transducer. That is, the load capacitor C may be used as a part of the LC filter.

FIG. 15 is a view illustrating an example of the configuration of a class-D power amplifier that uses a fourth-order LC low pass filter. In the case of a typical audio power amplifier, a load to be driven, which is shown in FIG. 15, is a resistive component (load resistor $R_L$). On the other hand, in the case when an electrostatic transducer is to be driven, it may be considered that a capacitor $C_2$, which is a part of the LC filter, is replaced by the electrostatic transducer and the capacitor $C_2$ is driven as the load capacitor $C_L$.

Referring to the circuit shown in FIG. 15, in a fourth-order LC filter that is configured to include $L_1$, $C_1$, $L_2$, $C_2$, and $R_L$ and is terminated at one end of the circuit, examples of an output voltage (terminal voltage of $C_2$), power supplied to a load capacitor $C_2$ ($C_L$), and a loss being consumed in a load resistor $R_L$ (used as a damping resistor) assuming that $C_2$ is used as the load capacitor (for example, $C_L$=5 nF) are shown in FIG. 16.

FIG. 16 is a view illustrating an example of a loss occurring in the load resistor $R_L$ when directly driving a load capacitor with a class-D power amplifier and an LC filter. As shown in FIG. 16, a flat output characteristic (output voltage) can be obtained with the load resistor $R_L$ having a proper resistance value. Instead, a loss much larger than the power (apparent power) supplied to the load capacitor occurs in the damping load resistor $R_L$ (refer to load resistor loss data in FIG. 16). As a result, an unnecessary loss occurs, and thus the circuit efficiency ranging from an amplifier to a load is lowered. In other words, in the case of driving a typical loudspeaker in the class-D power amplifier, a load resistor itself is a speaker and the unnecessary loss does not occur in portions other than a load to be driven, and as a result, it is possible to improve the circuit efficiency ranging from an amplifier to a load.

As described above, when directly driving the load capacitor C in the configuration of the class-D output stage and the LC filter which is a configuration of a typical class-D power amplifier for audio, an unnecessary loss occurs in the damping load resistor $R_L$ in the case of intending to obtain a flat output characteristic. As a result, a serious problem occurs in that the efficiency of the entire driving circuit is noticeably lowered. This is not preferable because the characteristic of the class-D power amplifier having high efficiency cannot be applied to a system.

FIG. 17 is a view illustrating a frequency characteristic of an output voltage in the case when there is no load resistor $R_L$ shown in FIG. 15. If the load resistor $R_L$ is removed or is changed to a resistor having a high resistance value in order to reduce the loss in the damping load resistor $R_L$, a resonance characteristic of the LC filter becomes noticeable and the frequency characteristic of the output voltage largely varies as shown in FIG. 17. In an example shown in FIG. 17, since a characteristic around a driving frequency band of an ultrasonic speaker varies largely, it is not possible to stably drive the ultrasonic speaker with the characteristic described above.

As described above, in the case when the class-D power amplifier is used in a driving circuit of the electrostatic transducer, if a damping resistor is removed or is changed to a resistor having a high resistance value in order to reduce the loss in the damping resistor, the resonance characteristic of the LC filter becomes noticeable and the frequency characteristic of the output voltage largely varies as shown in FIG. 17. In the example shown in FIG. 17, since the characteristic around the driving frequency band of the ultrasonic speaker varies largely, a problem has occurred in that it is not possible to stably drive the ultrasonic speaker with the characteristic described above.

SUMMARY

An advantage of some aspects of the invention is that it provides an electrostatic transducer capable of reducing a loss in a damping resistor and realizing a flat frequency characteristic in a driving frequency band in the case of using a class-D power amplifier and an LC filter, a method of setting a circuit constant of the electrostatic transducer, an ultrasonic speaker, a display device having the ultrasonic speaker, and a directional sound system. In addition, another advantage of some aspects of the invention is that it provides a driving circuit of a capacitive load capable of driving a different kind of capacitive load without being limited to the electrostatic transducer.

In order to achieve the above objects, according to an aspect of the invention, an electrostatic transducer includes: a class-D power amplifier that amplifies an input signal; and a low pass filter that has a plurality of pairs of inductors and capacitors, is connected to an output side of the class-D power amplifier, and serves to eliminate switching carrier components included in an output of the class-D power amplifier. A load capacitor of the electrostatic transducer serving as a driving load is disposed at a capacitor, which is closest to the output side of the low pass filter, of circuit elements forming the low pass filter, a coupling capacitor and an output transformer are interposed between the electrostatic load capacitor of the electrostatic transducer and an inductor closest to the output side of the low pass filter, and a damping resistor is connected in series to a primary coil of the output transformer.

In the configuration described above, since a driving circuit of the electrostatic transducer driven by the class-D power amplifier performs voltage raising and impedance conversion and has a characteristic of a BPF (band pass filter), in terms of the entire circuit, by applying the load capacitor as one of constituent components of the low pass filter and inserting the coupling capacitor, the damping resistor, and the output transformer in the LC low pass filter.

Accordingly, in the case of using the class-D power amplifier and the LC filter in order to drive the electrostatic transducer, it is possible to reduce a loss in the damping resistor and to realize a flat frequency characteristic in the driving frequency band.

In the electrostatic transducer described above, preferably, an output circuit, which includes the low pass filter, the coupling capacitor, the output transformer, and the load capacitor, is configured to have a first series resonance frequency f1, a second series resonance frequency f3, a third series resonance frequency f5, a first parallel resonance frequency f2, and a second parallel resonance frequency f4 as viewed from an input side of the low pass filter (f1<f2<f3<f4<f5), and each circuit constant is set such that the first parallel resonance frequency f2 matches or approximately matches a carrier wave frequency or a rated driving frequency of the electrostatic transducer.

In the configuration described above, the circuit constant is set such that the parallel resonance frequency f2 at the side of a load driven by the class-D power amplifier matches or approximately matches the carrier wave frequency or the rated driving frequency of the electrostatic transducer.

Thus, since the load-side impedance in a driving frequency band of the electrostatic transducer can be increased, it is possible to reduce the loss.

Further, in the electrostatic transducer described above, preferably, each circuit constant is set such that the second series resonance frequency f3 matches or approximately matches a cutoff frequency in a driving frequency band of the electrostatic transducer.

In the configuration described above, each circuit constant is set such that the second series resonance frequency f3 matches or approximately matches the cutoff frequency in the driving frequency band (pass band) of the electrostatic transducer.

Thus, since it is possible to block frequency components included in a frequency band lower than the driving frequency band (pass band) of the electrostatic transducer, it is possible to reduce output noises.

Furthermore, in the electrostatic transducer described above, preferably, an output circuit, which includes the low pass filter, the coupling capacitor, the output transformer, and the load capacitor, is configured to have a first series resonance frequency f1, a second series resonance frequency f3, a third series resonance frequency f5, a first parallel resonance frequency f2, and a second parallel resonance frequency f4 as viewed from an input side of the low pass filter (f1<f2<f3<f4<f5), and each circuit constant is set such that the second series resonance frequency f3 matches or approximately matches a cutoff frequency in a driving frequency band of the electrostatic transducer.

In the configuration described above, each circuit constant is set such that the second series resonance frequency f3 matches or approximately matches the cutoff frequency in the driving frequency band (pass band) of the electrostatic transducer.

Thus, since it is possible to block frequency components included in a frequency band other than the driving frequency band (pass band) of the electrostatic transducer, it is possible to reduce output noises.

Furthermore, in the electrostatic transducer described above, preferably, an output circuit, which includes the low pass filter, the coupling capacitor, the output transformer, and the load capacitor, is configured to have a first series resonance frequency f1, a second series resonance frequency f3, a third series resonance frequency f5, a first parallel resonance frequency f2, and a second parallel resonance frequency f4 as viewed from an input side of the low pass filter (f1<f2<f3<f4<f5), and each circuit constant is set such that the third series resonance frequency f5 is positioned in a band lower than a switching frequency band at an output stage of the class-D power amplifier.

In the configuration described above, each circuit constant is set such that the third series resonance frequency f5 is positioned in a band lower than the switching frequency band at the output stage of the class-D power amplifier.

Thus, since it is possible to make large an attenuation slope of the low pass filter in the switching frequency band at the output stage of the class-D power amplifier, the switching carrier components of the class-D power amplifier are sufficiently removed. As a result, it is possible to reduce output noises.

Furthermore, in the electrostatic transducer described above, preferably, an output circuit, which includes the low pass filter, the coupling capacitor, the output transformer, and the load capacitor, is configured to have a first series resonance frequency f1, a second series resonance frequency f3, a third series resonance frequency f5, a first parallel resonance frequency f2, and a second parallel resonance frequency f4 as viewed from an input side of the low pass filter (f1<f2<f3<f4<f5), each circuit constant is set such that the first parallel resonance frequency f2 matches or approximately matches a carrier wave frequency or a rated driving frequency of the electrostatic transducer, and each circuit constant is set such that the second series resonance frequency f3 matches or approximately matches a cutoff frequency in a driving frequency band of the electrostatic transducer.

In the configuration described above, the circuit constant is set such that the first parallel resonance frequency f2 matches or approximately matches the carrier wave frequency or the rated driving frequency of the electrostatic transducer and the second series resonance frequency f3 matches or approximately matches the cutoff frequency in the driving frequency band (pass band) of the electrostatic transducer.

Thus, in the driving circuit of the electrostatic transducer, it is possible to reduce the loss in the driving frequency band of the transducer. In addition, since it is possible to block frequency components included in a frequency band other than the driving frequency band (pass band) of the electrostatic transducer, it is possible to reduce output noises.

Furthermore, in the electrostatic transducer described above, preferably, an output circuit, which includes the low pass filter, the coupling capacitor, the output transformer, and the load capacitor, is configured to have a first series resonance frequency f1, a second series resonance frequency f3, a third series resonance frequency f5, a first parallel resonance frequency f2, and a second parallel resonance frequency f4 as viewed from an input side of the low pass filter (f1<f2<f3<f4<f5), each circuit constant is set such that the second series resonance frequency f3 matches or approximately matches a cutoff frequency in a driving frequency band of the electrostatic transducer, and each circuit constant is set such that the third series resonance frequency f5 is positioned in a band lower than a switching frequency band at an output stage of the class-D power amplifier.

In the configuration described above, each circuit constant is set such that the second series resonance frequency f3 matches or approximately matches the cutoff frequency in the driving frequency band (pass band) of the electrostatic transducer, and each circuit constant is set such that the third series resonance frequency f5 is positioned in a band lower than the switching frequency band at the output stage of the class-D power amplifier.

Thus, it is possible to block frequency components included in a frequency band other than the driving frequency band (pass band) of the electrostatic transducer. In addition, since the attenuation slope of the low pass filter in the switching frequency band at the output stage of the class-D power amplifier becomes large and the switching carrier components in the class-D power amplifier are sufficiently removed, it is possible to reduce the output noises.

Furthermore, in the electrostatic transducer described above, preferably, an output circuit, which includes the low pass filter, the coupling capacitor, the output transformer, and the load capacitor, is configured to have a first series resonance frequency f1, a second series resonance frequency f3, a third series resonance frequency f5, a first parallel resonance frequency f2, and a second parallel resonance frequency f4 as viewed from an input side of the low pass filter (f1<f2<f3<f4<f5), each circuit constant is set such that the first parallel resonance frequency f2 matches or approximately matches a carrier wave frequency or a rated driving frequency of the electrostatic transducer, each circuit constant is set such that the second series resonance frequency f3 matches or approximately matches a cutoff frequency in a driving frequency band of the electrostatic transducer, and each circuit constant is set such that the third series resonance frequency f5 is positioned in a band lower than a switching frequency band at an output stage of the class-D power amplifier.

In the configuration described above, each circuit constant is set such that the first parallel resonance frequency f2 matches or approximately matches the carrier wave frequency or the rated driving frequency of the electrostatic transducer, each circuit constant is set such that the second series resonance frequency f3 matches or approximately matches the cutoff frequency in the driving frequency band (pass band) of the electrostatic transducer, and each circuit constant is set such that the third series resonance frequency f5 is positioned in a band lower than the switching frequency band at the output stage of the class-D power amplifier.

Thus, in the driving circuit of the electrostatic transducer, it is possible to make small a loss in the entire driving circuit by reducing both a loss in a load resistor in the driving frequency band of the transducer and a loss in an output-stage element of the power amplifier. In addition, it is possible to block frequency components included in a frequency band other than the driving frequency band (pass band) of the electrostatic transducer. In addition, since switching carrier components in the class-D power amplifier are sufficiently removed, it is possible to reduce the output noises.

Furthermore, in the electrostatic transducer described above, preferably, the low pass filter having the load capacitor is a fourth-order LC low pass filter.

In the configuration described above, the fourth-order low pass filter, which is configured to include an inductor and a capacitor and an inductor and a capacitor (load capacitor), is provided behind the class-D power amplifier.

Thus, it is possible to block frequency components included in a frequency band other than the driving frequency band (pass band) of the electrostatic transducer. In addition, since the switching carrier components in the class-D power amplifier are sufficiently removed, it is possible to reduce the output noises.

Furthermore, in the electrostatic transducer described above, it is preferable to further include a first-surface-side fixed electrode formed with a plurality of holes; a second-surface-side fixed electrode formed with a plurality of holes, the second-surface-side fixed electrode and the first-surface-side fixed electrode forming a pair; and a vibrating film that is interposed between the pair of fixed electrodes and has a conductive layer to which a DC bias voltage is applied. In addition, preferably, a center tap is provided in a secondary coil of the output transformer, one end of the secondary coil of the output transformer is connected to the first-surface-side fixed electrode of the electrostatic transducer and the other end thereof is connected to the second-surface-side fixed electrode, and the DC bias voltage is applied to the conductive layer of the vibrating film by using the center tap of the secondary coil of the output transformer as a reference.

In the configuration described above, for example, a push-pull electrostatic transducer shown in FIG. 6 is used as the electrostatic transducer driven by the class-D power amplifier. In addition, one end of the secondary coil of the output transformer is connected to a front-surface-side (first-surface-side) fixed electrode and the other end thereof is connected to a bottom-surface-side (second-surface-side) fixed electrode, and the DC bias voltage is applied to the conductive layer of the vibrating film by using the center tap of the secondary coil of the output transformer as a reference.

Thus, due to the class-D power amplifier, the push-pull electrostatic transducer can be driven over the wide range with a low loss. In particular, in the case when the electrostatic transducer circuit is used as an ultrasonic speaker, the quality of a reproduced sound can be improved due to the flat output characteristic.

Furthermore, in the electrostatic transducer described above, preferably, the electrostatic transducer is configured to be driven by a signal in an ultrasonic frequency band.

Thus, the electrostatic transducer described above can be used as an ultrasonic speaker. In addition, the ultrasonic speaker can be stably driven over the wide range with a low loss.

According to another aspect of the invention, an ultrasonic speaker includes an electrostatic transducer driven by a signal in an ultrasonic frequency band. A modulated signal, which is obtained by modulating a carrier wave signal in the ultrasonic frequency band with a sound signal in an audible frequency band, is supplied as an input signal of the electrostatic transducer. The electrostatic transducer includes: a class-D power amplifier that amplifies an input signal; and a low pass filter that has a plurality of pairs of inductors and capacitors, is connected to an output side of the class-D power amplifier, and serves to eliminate switching carrier components included in an output of the class-D power amplifier. An electrostatic load capacitor of the electrostatic transducer serving as a driving load is disposed at a capacitor, which is closest to the output side of the class-D power amplifier, of circuit elements forming the low pass filter, an electrostatic coupling capacitor and an output transformer are interposed between the electrostatic load capacitor of the electrostatic transducer and an inductor closest to the output side of the class-D power amplifier of the low pass filter, and a damping resistor is connected in series to a primary coil of the output transformer.

In the configuration described above, the carrier wave in the ultrasonic frequency band is modulated with the signal wave in the audible frequency band, the modulated signal is amplified by the class-D power amplifier, and the amplified modulated signal is applied to the electrostatic transducer through the low pass filter, the coupling capacitor, the damping resistor, and the output transformer.

Thus, in the case when the ultrasonic speaker is formed by using the electrostatic ultrasonic transducer and the ultrasonic speaker is driven by the class-D power amplifier, the ultrasonic speaker can be stably driven over the wide range with a low loss. As a result, it is possible to improve the quality of a reproduced sound in the ultrasonic speaker.

Further, according to still another aspect of the invention, a driving circuit of a capacitive load includes: a class-D power amplifier that amplifies an input signal; and a low pass filter that has a plurality of pairs of inductors and capacitors, is connected to an output side of the class-D power amplifier, and serves to eliminate switching carrier components included in an output of the class-D power amplifier. An electrostatic load capacitor of the capacitive load serving as a driving load is disposed at a capacitor, which is closest to the output side of the class-D power amplifier, of circuit elements forming the low pass filter, an electrostatic coupling capacitor and an output transformer are interposed between the electrostatic load capacitor of the capacitive load and an inductor closest to the output side of the class-D power amplifier of the low pass filter, and a damping resistor is connected in series to a primary coil of the output transformer.

In the configuration described above, since the driving circuit of a capacitive load (for example, an electrostatic transducer) driven by the class-D power amplifier performs voltage raising and impedance conversion and has a characteristic of a BPF, in terms of the entire circuit, by applying the electrostatic load capacitor as one of constituent components of the low pass filter and inserting the electrostatic coupling capacitor, the damping resistor, and the output transformer in the LC low pass filter.

Accordingly, in the case of using the class-D power amplifier in order to drive the capacitive load (for example, an electrostatic transducer), it is possible to realize a high voltage or a flat output voltage frequency characteristic and to reduce a loss in the entire driving circuit by reducing both a loss in a load resistor in the driving frequency band of the capacitive load and a loss in the output-stage element of the power amplifier.

In the driving circuit of a capacitive load, preferably, an output circuit, which includes the low pass filter, the electrostatic coupling capacitor, the output transformer, and the electrostatic load capacitor, is configured to have a first series resonance frequency f1, a second series resonance frequency f3, a third series resonance frequency f5, a first parallel resonance frequency f2, and a second parallel resonance frequency f4 as viewed from an input side of the low pass filter ($f1<f2<f3<f4<f5$). In addition, preferably, each circuit constant is set such that the first parallel resonance frequency f2 matches or approximately matches a carrier wave frequency or a rated driving frequency of the capacitive load, each circuit constant is set such that the second series resonance frequency f3 matches or approximately matches a cutoff frequency in a driving frequency band of the capacitive load, each circuit constant is set such that the third series resonance frequency f5 is positioned in a band lower than a switching frequency band at an output stage of the class-D power amplifier, and each circuit constant is set such that a gain response in a frequency band between the series resonance frequencies f1 and f3 is as flat as possible.

In the configuration described above, the driving circuit, which includes the low pass filter, the coupling capacitor, the output transformer, and the load capacitor, is configured to have the first series resonance frequency f1, the second series resonance frequency f3, the third series resonance frequency f5, the first parallel resonance frequency f2, and the second parallel resonance frequency f4 as viewed from the input side ($f1<f2<f3<f4<f5$), each circuit constant is set such that the first parallel resonance frequency f2 matches or approximately matches the carrier wave frequency or the rated driving frequency of the capacitive load (for example, an electrostatic transducer) each circuit constant is set such that the second series resonance frequency f3 matches or approximately matches the cutoff frequency in the driving frequency band (pass band) of the capacitive load, and each circuit constant is set such that the third series resonance frequency f5 is positioned in a band lower than the switching frequency band at the output stage of the class-D power amplifier. In addition, each circuit constant is set such that the gain response in a frequency band between the series resonance frequencies f1 and f3 is as flat as possible.

Accordingly, in the case of using the class-D power amplifier in order to drive the capacitive load (for example, an electrostatic transducer), it is possible to realize a high voltage and a flat output voltage frequency characteristic and to reduce a loss in the entire driving circuit by reducing both a loss in a load resistor in the driving frequency band of the capacitive load and a loss in the output-stage element of the power amplifier. In addition, it is possible to block frequency components included in a frequency band other than the driving frequency band (pass band) of the capacitive load. In addition, since switching carrier components in the class-D power amplifier are sufficiently removed, it is possible to reduce the output noises.

Furthermore, according to still another aspect of the invention, a method of setting a circuit constant in a driving circuit of an electrostatic transducer, which includes: a class-D power amplifier that amplifies an input signal; and a low pass filter that is connected to an output side of the class-D power amplifier, serves to eliminate switching carrier components included in an output of the class-D power amplifier, and has two pairs of inductors and capacitors, an electrostatic load capacitor of the electrostatic transducer serving as a driving load is disposed at a capacitor, which is closest to the output side of the class-D power amplifier, of circuit elements forming the low pass filter, an electrostatic coupling capacitor and an output transformer are interposed between the electrostatic load capacitor of the electrostatic transducer and an inductor closest to the output side of the class-D power amplifier of the low pass filter, and a damping resistor is connected in series to a primary coil of the output transformer includes: setting an output circuit, which includes the low pass filter, the electrostatic coupling capacitor, the output transformer, and the electrostatic load capacitor, to have a first series resonance frequency f1, a second series resonance frequency f3, a third series resonance frequency f5, a first parallel resonance frequency f2, and a second parallel resonance frequency f4 as viewed from an input side of the low pass filter ($f1<f2<f3<f4<f5$); setting a driving condition including an electrostatic load capacitance value, a driving frequency band, and a maximum driving voltage with respect to an electrostatic transducer to be driven; setting a self-inductance value such that a resonance frequency (parallel resonance frequency) due to the electrostatic load capacitor and a secondary coil of the transformer matches or approximately matches a center frequency in the driving frequency band of the electrostatic transducer; setting a voltage raising ratio of the transformer and a self-inductance value of the primary coil of the transformer; setting a circuit constant of an LC filter such that a series resonance frequency f3 becomes approximately a cutoff frequency in a high band of the driving frequency band and a series resonance frequency f5 is away from a switching frequency band of the class-D power amplifier toward a low band side of the driving frequency band; setting a value of the electrostatic coupling capacitor such that a gain response in a frequency band between series resonance frequencies f1 and f3 is as flat as possible; and setting a resistive value of the damping resistor such that the frequency band between the series resonance frequencies f1 and f3 has a flat pass characteristic with no peak.

In the procedures described above, the self-inductance value of the secondary coil of the transducer is set such that the first parallel resonance frequency f2 approximately matches a rated driving frequency (or a carrier wave frequency) of the electrostatic transducer, the voltage raising ratio of the transformer and the self-inductance value of the primary coil of the transformer are set, the circuit constant of the LC filter is set such that the second series resonance frequency f3 becomes approximately a cutoff frequency in a high band of the driving frequency band and the third series resonance frequency f5 is away from the switching frequency band of the class-D power amplifier toward the low band side of the driving frequency band, the value of the electrostatic coupling capacitor is set such that the gain response in the frequency band between the series resonance frequencies f1 and f3 is as flat as possible, and the resistive value of the damping resistor is set such that the frequency band between the series resonance frequencies f1 and f3 has a flat pass characteristic with no peak.

Thus, even in the case of using the class-D power amplifier in order to drive the electrostatic transducer, it is possible to realize a high voltage and a flat output voltage frequency characteristic and to reduce a loss in the entire driving circuit by reducing both a loss in a load resistor in the driving frequency band of the transducer and a loss in the output-stage element of the power amplifier. In addition, it is possible to block frequency components included in a frequency band other than the driving frequency band (pass band) of the electrostatic transducer. In addition, since switching carrier components in the class-D power amplifier are sufficiently removed, it is possible to reduce the output noises.

Furthermore, according to still another aspect of the invention, a method of setting a circuit constant in an electrostatic transducer, which includes: a class-D power amplifier that amplifies an input signal; and a low pass filter that has a plurality of pairs of inductors and capacitors, is connected to an output side of the class-D power amplifier, and serves to eliminate switching carrier components included in an output of the class-D power amplifier, an electrostatic load capacitor of the electrostatic transducer serving as a driving load is disposed at a capacitor, which is closest to the output side of the class-D power amplifier, of circuit elements forming the low pass filter, an electrostatic coupling capacitor and an output transformer are interposed between the electrostatic load capacitor of the electrostatic transducer and an inductor closest to the output side of the class-D power amplifier of the low pass filter, and a damping resistor is connected in series to a primary coil of the output transformer includes: setting an output circuit, which includes the low pass filter, the electrostatic coupling capacitor, the output transformer, and the electrostatic load capacitor, to have a first series resonance frequency f1, a second series resonance frequency f3, a third series resonance frequency f5, a first parallel resonance frequency f2, and a second parallel resonance frequency f4 as viewed from an input side of the low pass filter ($f1<f2<f3<f4<f5$); and setting each circuit constant such that the first parallel resonance frequency f2 matches or approximately matches a carrier wave frequency or a rated driving frequency of the electrostatic transducer.

In the procedures described above, the circuit constant is set such that the parallel resonance frequency f2 at the side of a load driven by the class-D power amplifier matches or approximately matches the carrier wave frequency or the rated driving frequency of the electrostatic transducer.

Thus, since the load-side impedance in the driving frequency band of the electrostatic transducer can be increased, it is possible to reduce the loss.

In the method of setting a circuit constant described above, it is preferable to further include setting each circuit constant such that the second series resonance frequency f3 matches or approximately matches a cutoff frequency in a driving frequency band of the electrostatic transducer.

In the procedure described above, each circuit constant is set such that the second series resonance frequency f3 matches or approximately matches the cutoff frequency in the driving frequency band (pass band) of the electrostatic transducer.

Thus, since it is possible to block frequency components included in a frequency band lower than the driving frequency band (pass band) of the electrostatic transducer, it is possible to reduce the output noises.

Furthermore, in the method of setting a circuit constant described above, it is preferable to further include setting each circuit constant such that the third series resonance frequency f5 is positioned in a band lower than a switching frequency band at an output stage of the class-D power amplifier.

In the procedure described above, each circuit constant is set such that the third series resonance frequency f5 is positioned in a band lower than the switching frequency band at the output stage of the class-D power amplifier.

Thus, since it is possible to make large an attenuation slope of the low pass filter in the switching frequency band at the output stage of the class-D power amplifier, the switching carrier components of the class-D power amplifier are sufficiently removed. As a result, it is possible to reduce the output noises.

Furthermore, in the method of setting a circuit constant described above, it is preferable to further include: setting each circuit constant such that the second series resonance frequency f3 matches or approximately matches a cutoff frequency in a driving frequency band of the electrostatic transducer; and setting each circuit constant such that the third series resonance frequency f5 is positioned in a band lower than a switching frequency band at an output stage of the class-D power amplifier.

In the procedure described above, each circuit constant is set such that the second series resonance frequency f3 matches or approximately matches the cutoff frequency in the driving frequency band (pass band) of the electrostatic transducer and each circuit constant is set such that the third series resonance frequency f5 is positioned in a band lower than the switching frequency band at the output stage of the class-D power amplifier.

Thus, it is possible to block frequency components included in a frequency band other than the driving frequency band (pass band) of the electrostatic transducer. In addition, since the attenuation slope of the low pass filter in the switching frequency band at the output stage of the class-D power amplifier becomes large and the switching carrier components in the class-D power amplifier are sufficiently removed, it is possible to reduce the output noises.

According to still another aspect of the invention, a display device includes: an ultrasonic speaker that reproduces a signal sound in an audible frequency band by modulating a carrier wave signal in an ultrasonic frequency band with a sound signal supplied from a sound source and then driving an electrostatic transducer with the modulated signal; and a projection optical system that projects an image onto a projection surface. The electrostatic transducer included in the ultrasonic speaker includes: a class-D power amplifier that amplifies an input signal; and a low pass filter that has a plurality of pairs of inductors and capacitors, is connected to an output side of the class-D power amplifier, and serves to eliminate switching carrier components included in an output of the class-D power amplifier, and an electrostatic load capacitor of the electrostatic transducer serving as a driving load is disposed at a capacitor, which is closest to the output side of the class-D power amplifier, of circuit elements forming the low pass filter. An electrostatic coupling capacitor and an output transformer are interposed between the electrostatic load capacitor of the electrostatic transducer and an inductor closest to the output side of the class-D power amplifier of the low pass filter, and a damping resistor is connected in series to a primary coil of the output transformer.

In the display device having the configuration described above, the ultrasonic speaker including the electrostatic transducer is used. In addition, the sound signal supplied from the sound source is reproduced by the ultrasonic speaker.

Thus, it is possible to use an ultrasonic speaker that has a flat output frequency characteristic and can be driven with a low loss in the display device. For this reason, it is possible to reproduce the sound signal that has a sufficient sound pressure and a wide-band characteristic and is generated from a virtual sound source formed around a sound wave reflecting surface, such as a screen. In addition, the control of the spatial reproduction range can be easily performed.

In addition, according to still another aspect of the invention, a directional sound system includes: an ultrasonic speaker that reproduces a signal, which belongs to a first sound range, of sound signals supplied from a sound source; and a reproducing speaker that reproduces a signal, which belongs to a second sound range, of the sound signals supplied from the sound source. The sound signals supplied from the sound source are reproduced by the ultrasonic speaker and a virtual sound source is formed in the vicinity of a sound wave reflecting surface, such as a screen. An electrostatic transducer included in the ultrasonic speaker includes: a class-D power amplifier that amplifies an input signal; and a low pass filter that has a plurality of pairs of inductors and capacitors, is connected to an output side of the class-D power amplifier, and serves to eliminate switching carrier components included in an output of the class-D power amplifier. An electrostatic load capacitor of the electrostatic transducer serving as a driving load is disposed at a capacitor, which is closest to the output side of the class-D power amplifier, of circuit elements forming the low pass filter, an electrostatic coupling capacitor and an output transformer are interposed between the electrostatic load capacitor of the electrostatic transducer and an inductor closest to the output side of the class-D power amplifier of the low pass filter, and a damping resistor is connected in series to a primary coil of the output transformer.

In the directional sound system having the configuration described above, the ultrasonic speaker including the electrostatic transducer is used. In addition, a sound signal, which belongs to the middle and high sound range (first sound range), of sound signals supplied from the sound source is reproduced by the ultrasonic speaker. In addition, a sound signal, which belongs to the bass range (second sound range), of the sound signals supplied from the sound source is reproduced by a bass-reproducing speaker.

Thus, in the directional sound system, it is possible to use an ultrasonic speaker that is driven by the class-D power amplifier, has a flat output frequency characteristic, and can be driven with a low loss. For this reason, it is possible to reproduce the sounds within the middle and high sound range, which have a sufficient sound pressure and a wide-band characteristic and are generated from a virtual sound source formed around a sound wave reflecting surface, such as a screen. In addition, the sound within a bass range is directly output from the bass-reproducing speaker included in the sound system, and accordingly, bass sounds can be reinforced. As a result, it is possible to create an acoustic environment that is much real.

BRIEF DESCRIPTION OF THE DRAWINGS

The invention will be described with reference to the accompanying drawings, wherein like numbers reference like elements.

DESCRIPTION OF EXEMPLARY EMBODIMENTS

Explanation on a Driving Circuit of an Electrostatic Transducer According to an Embodiment of the Invention First, a driving circuit of an electrostatic transducer using a class-D power amplifier according to an embodiment of the invention will be described.

The driving circuit of the electrostatic transducer according to the embodiment of the invention has a characteristic of a BPF, in terms of the entire circuit, by applying a load capacitor as one of constituent components of a low pass filter and inserting a coupling capacitor, a damping resistor, and an output transformer in the low pass filter in the driving circuit of the electrostatic transducer driven by a class-D power amplifier. This makes it possible to realize a flat output voltage frequency characteristic and to reduce a circuit loss in a driving frequency band of a transducer. Accordingly, it is possible to reduce both a loss in a load resistor and a loss in an output-stage element of a power amplifier, such that a loss in the entire driving circuit can be reduced.

Figure 1:
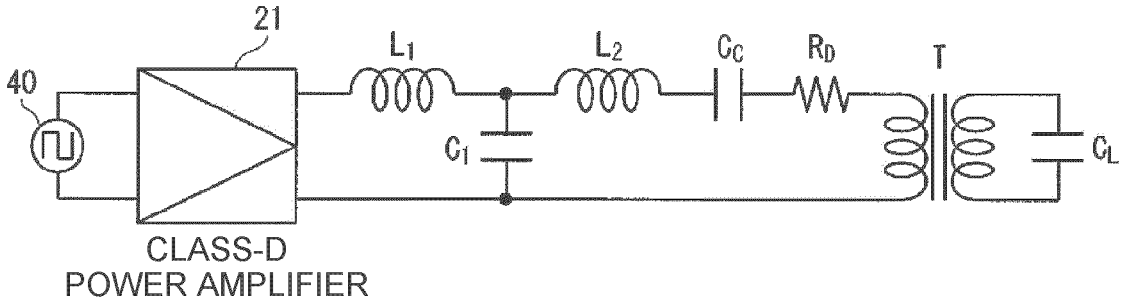
FIG. 1 is a view illustrating an example of the configuration of a driving circuit of an electrostatic transducer according to an embodiment of the invention.
Figure 14:
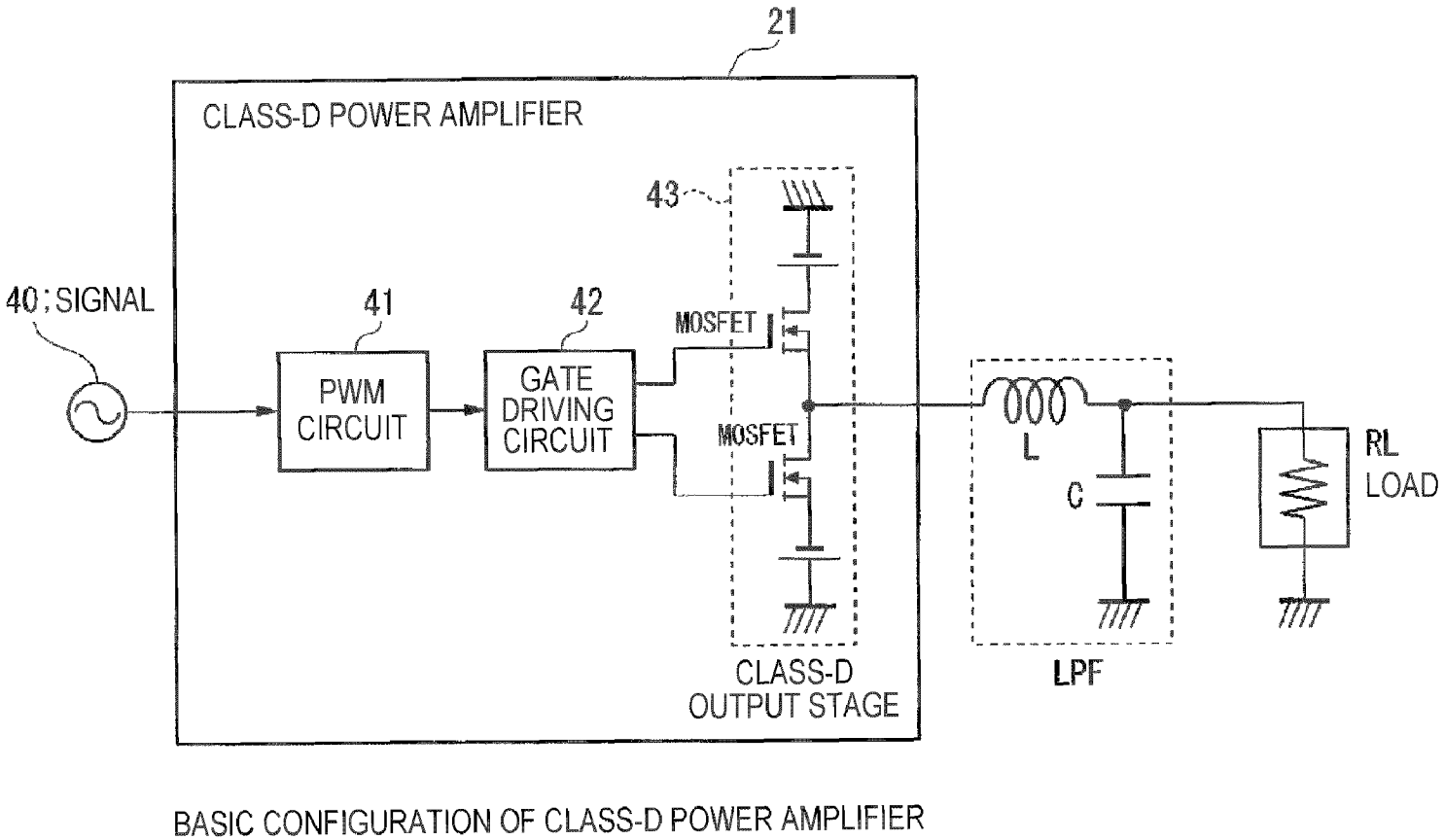
FIG. 14 is a view illustrating an example of the configuration of a typical class-D power amplifier.
Figure 15:
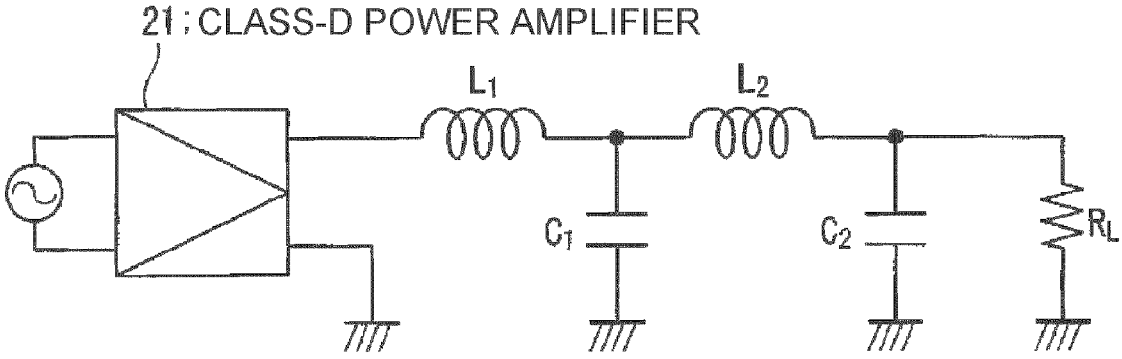
FIG. 15 is a view illustrating an example of the configuration of a class-D power amplifier that uses a fourth-order LC low pass filter.
Figure 16:
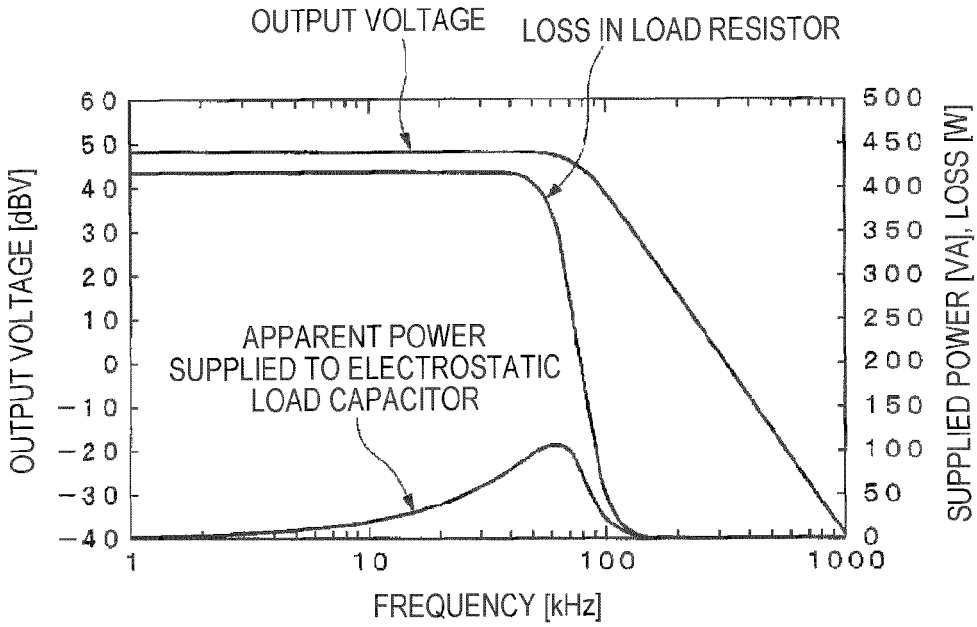
FIG. 16 is a view illustrating an example of a loss occurring in a damping resistor when driving an electrostatic load capacitor.
Figure 17:
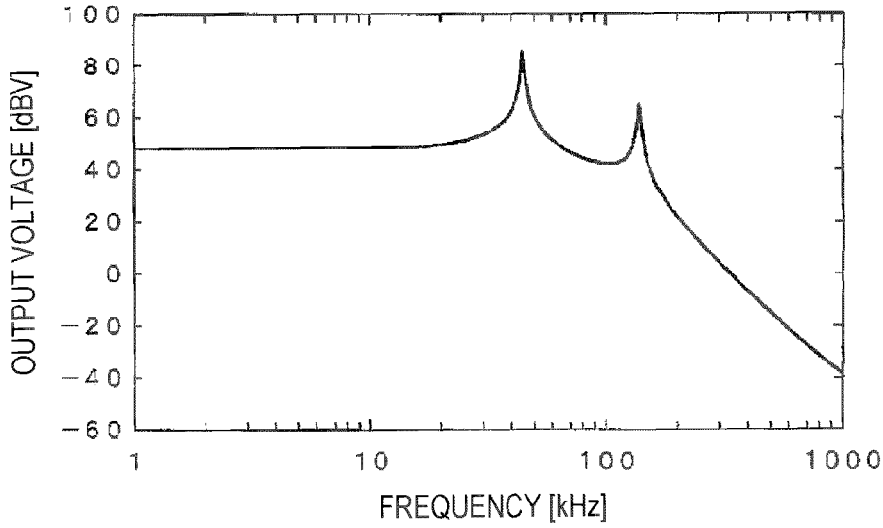
FIG. 17 is a view illustrating a frequency characteristic of an output voltage when there is no damping resistor.

FIG. 1 is a view illustrating an example of the configuration of a driving circuit of an electrostatic transducer according to an embodiment of the invention. Referring to FIG. 1, a class-D power amplifier 21 is configured to include a PWM circuit (or a PDM circuit) 41, a gate driving circuit 42, and a class-D output stage 43, as shown in FIG. 14. In addition, the class-D power amplifier 21 outputs a switching wave obtained by modulating an input signal 40 in a PWM (PDM) method. Here, since the class-D power amplifier 21 has the same configuration as a typical class-D power amplifier, a detailed explanation thereof will be omitted.

A fourth-order low pass filter (LC low pass filter) having $L_1$, $C_1$, $L_2$, and $C_L$ is connected subsequent to the class-D power amplifier 21. Here, the load capacitor $C_L$ of the electrostatic transducer is applied as a last-stage capacitance portion (capacitance component) of the low pass filter. In addition, the electrostatic transducer can be expressed in an equivalent manner by using the load capacitor $C_L$ assuming that a resistive component and an inductive component are so small as to be neglected. An example of the electrostatic transducer will be described later (refer to FIGS. 6A to 6C).

In addition, a coupling capacitor $C_C$ and a damping resistor $R_D$ are connected between the inductor $L_2$ and the load capacitor $C_L$, and gain conversion (impedance conversion) is performed by an output transformer T. The load capacitor $C_L$ is connected to a secondary side of the output transformer T.

Next, an operation of the circuit shown in FIG. 1 will be described. As described earlier, since an operation of the class-D power amplifier 21 shown in FIG. 1 is the same as that of a typical class-D power amplifier, an explanation thereof will be omitted. Here, an operation of an output circuit portion subsequent to the class-D power amplifier 21 will be described.

Thereafter, an example in which the circuit shown in FIG. 1 is driven in the following conditions will be described. It is assumed that a load is an electrostatic transducer, a total capacitance $C_L$ of the load is 5 nF, a driving frequency band is in a range of 40 to 80 kHz, and a driving voltage is 250 V. In addition, it is assumed that a switching frequency of a class-D power amplifier is about 500 kHz (to 1 MHz).

Referring to FIG. 1, $L_1$, $C_1$, $L_2$, and $C_L$ form a fourth-order low pass filter. Each of the circuit constant values is set on the basis of procedures of setting a circuit constant to be described later such that a cutoff frequency (−3 dB attenuation frequency) of the low pass filter becomes about 80 kHz. Furthermore, in a frequency band equal to or larger than 500 kHz that is a frequency band of a switching carrier output from the class-D power amplifier (output stage) 21, each of the circuit constant values is set to be a fourth-order (−24 dB/octave) attenuation slope, and switching carrier components are sufficiently eliminated and then a signal, which is obtained by eliminating the switching carrier components, is applied to the load capacitor $C_L$.

In addition, the inductors $L_1$ and $L_2$, the coupling capacitor $C_C$, and a primary-side coil inductance of the output transformer T form a high pass filter (LC high pass filter). Each of the circuit constant values is set by a procedure of setting a circuit constant to be described later such that a cutoff frequency of the high pass filter becomes about 40 kHz. Due to the resonance characteristic of the high pass filter, a gain in a low-band side of the driving frequency band (pass band) can be increased, and thus it is possible to make a gain characteristic of the entire pass band approximately flat.

The damping resistor $R_D$ serves to lower both a quality factor (Q factor) of the low pass filter and a quality factor (Q factor) of the high pass filter. As a result, it is possible to realize a flat pass characteristic having no resonating peak in a frequency characteristic of an output voltage.

Figure 2:
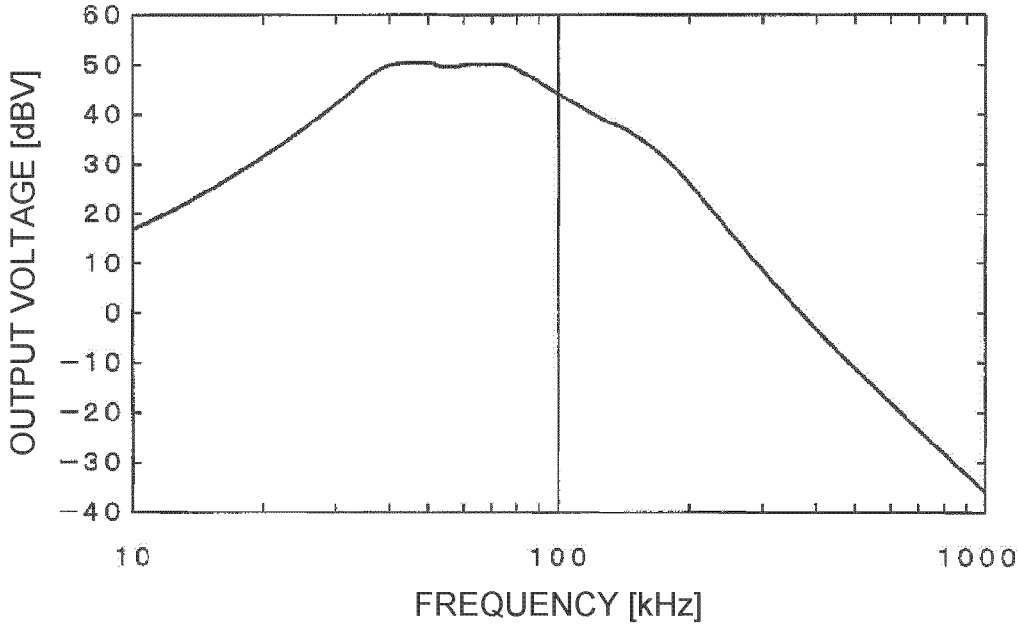
FIG. 2 is a view illustrating an example of a frequency characteristic of an output voltage (load terminal voltage) of the circuit shown in FIG. 1.

FIG. 2 is a view illustrating an example of the frequency characteristic of the output voltage (load terminal voltage) of the circuit shown in FIG. 1, and the flat frequency characteristic shown in FIG. 2 can be realized by properly setting each circuit constant.

The output transformer T serves to perform voltage raising and impedance conversion in the LC filter. Here, a gain of the output transformer T is set to 10. The coil inductance of the output transformer T is used as a constituent component of the high pass filter. Further, an inductance value of the coil inductance of the transformer is set such that a resonating frequency of a parallel resonating circuit, which is formed by the coil inductance of the output transformer T and the load capacitor $C_L$, is located within the driving frequency band (40 kHz to 80 kHz). Thus, it is possible to suppress the loss in the damping resistor $R_D$ within the driving frequency band so as to be small.

Next, a method of setting a circuit constant in the driving circuit according to the embodiment of the invention will be described.

Figure 3:
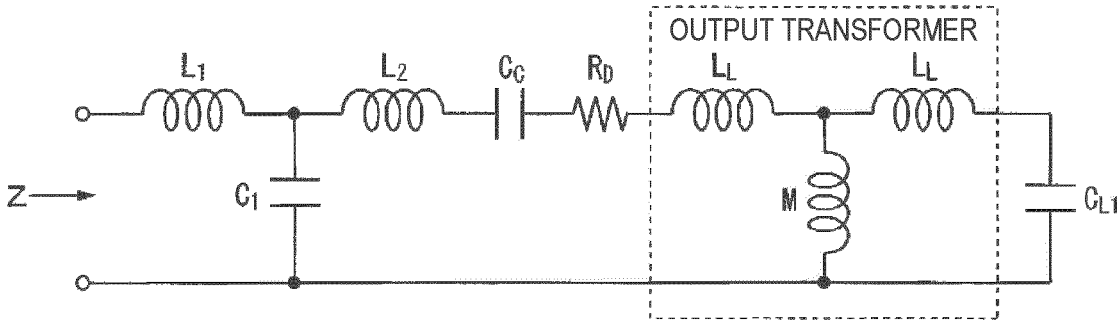
FIG. 3 is a view illustrating an equivalent circuit of an output circuit portion.

FIG. 3 is a view illustrating an equivalent circuit of the output circuit portion (a capacitive value of the load capacitor is converted to cause the load capacitor to be reflected in the primary side of the output transformer T). An output circuit subsequent to the low pass filter shown in FIG. 1 can be expressed in the equivalent circuit shown in FIG. 3. Here, $L_L$ denotes a leakage inductance (inductance of a primary coil when a secondary coil of the output transformer T is short-circuited) of the output transformer T, and M denotes a mutual inductance of the output transformer T. Moreover, in FIG. 3, a resistance of the filter coil and a coil resistance of the output transformer T are neglected, and a capacitive value of the load capacitor $C_L$ shown in FIG. 1 is converted to cause the load capacitor $C_L$ to be reflected in the primary side of the output transformer T, thereby being expressed as a load capacitor $C_{L1}$. In addition, the gain of the output transformer T is also neglected.

The circuit constant is set by obtaining a resonating frequency (zero point and pole) of the circuit shown in FIG. 3 and then considering the positional relationship among each resonating frequency position, a required load driving frequency band, and a switching frequency band of a class-D power amplifier.

In the circuit shown in FIG. 3, assuming that $R_L=0$ (resistive components within the circuit are all neglected) an impedance Z viewed from an amplifier side (a left side of FIG. 3) can be expressed in the following equation in which ω is an angular frequency, $A_n$, $B_n$, $C_n$, $D_n$, $A_d$, $B_d$, and $C_d$ are coefficients, and j is a unit of an imaginary number.

$$Z = \frac{A_n\omega^6 + B_n\omega^4 + C_n\omega^2 + D_n}{j\omega(A_d\omega^4 \div B_d\omega^2 \div C_d} \quad \text{Equation 1}$$

At this time, $A_n$, $B_n$, $C_n$, $D_n$, $A_d$, $B_d$, and $C_d$ are as follows.

$$A_n=-(L_2M+L_2L_L+2ML_L+L_L^2)L_1C_1C_CC_{L1}$$

$$B_n=(L_2+M+L_L)L_1C_1C_C+(M+L_L)(L_1C_1C_{L1}+L_1C_CC_{L1}+L_2C_CC_{L1})+(2M+L_L)L_LC_CC_{L1}$$

$$C_n=-\{L_1C_1+(L_1+L_2+M+L_L)C_C+(M+L_L)C_{L1}\}$$

$$D_n=1$$

$$A_d=(L_2M+L_2L_L+2ML_L+L_L^2)C_1C_CC_{L1}$$

$$B_d=-\{(L_2+M+L_L)C_1C_C+(M+L_L)(C_1+C_C)C_{L1}\}$$

$$C_d=C_1+C_C \quad \text{Equation 2}$$

When the impedance of the circuit is expressed in the above equation 1, ω satisfying following equation 3 corresponds to a zero point (series resonance angular frequency) and ω satisfying following equation 4 corresponds to a pole (parallel resonance angular frequency).

$$A_n\omega^6+B_n\omega^4+C_n\omega^2+D_n=0 \quad \text{Equation 3:}$$

$$A_d\omega^4+B_d\omega^2+C_d=0 \quad \text{Equation 4:}$$

From the above equations, it can be seen that for a zero point, three roots (ω1, ω3, and ω5) are obtained in a positive frequency region. It is difficult to solve the above equations in an analytical method; however, the zero point can be found by obtaining a curve of equation '$y=A_n\omega^6+B_n\omega^4+C_n\omega^2+D_n$' on the basis of numeric calculation using ω as a variable and by examining a value of ω at the time of y=0.

On the other hand, parallel resonance angular frequencies of ω2 [rad/sec] and ω4 [rad/sec] can be easily obtained in the analytical method.

$$\omega_2 = \sqrt{\frac{-B_d - \sqrt{B_d^2 - 4A_dC_d}}{2A_d}}, \quad \omega_4 = \sqrt{\frac{-B_d + \sqrt{B_d^2 - 4A_dC_d}}{2A_d}} \quad \text{Equation 5}$$

Accordingly, parallel resonance frequencies (pole frequencies) of f2 [Hz] and f4 [Hz] can be obtained in the following equation.

$$f_2 = \frac{1}{2\pi}\sqrt{\frac{-B_d - \sqrt{B_d^2 - 4A_dC_d}}{2A_d}}, \quad f_2 = \frac{1}{2\pi}\sqrt{\frac{-B_d + \sqrt{B_d^2 - 4A_dC_d}}{2A_d}} \quad \text{Equation 6}$$

Figure 4:
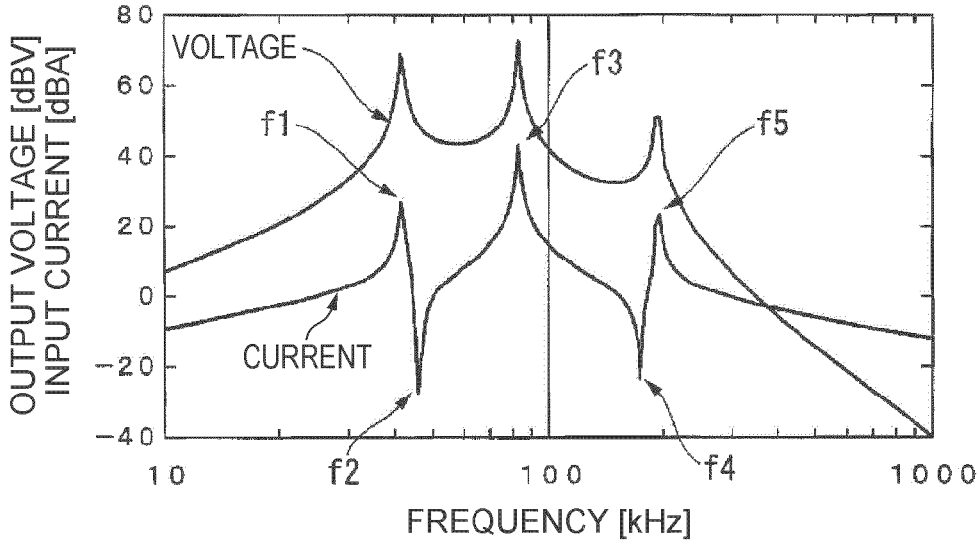
FIG. 4 is a view illustrating examples of frequency characteristics of an output voltage and a circuit input current of the circuit shown in FIG. 3.

FIG. 4 is a view illustrating examples of frequency characteristics of an output voltage and a circuit input current of the circuit shown in FIG. 3. Specifically, FIG. 4 illustrates examples (in this case, resistive components are all neglected) of frequency characteristics of an output voltage (load terminal voltage) and a circuit input current (current $L_1$) of the equivalent circuit shown in FIG. 3 and illustrates a frequency characteristic corresponding to three series resonance frequencies (zero points) f1, f3, and f5, and two parallel resonance frequencies (poles) f2 and f4.

Referring to FIG. 4, each circuit constant is set. Hereinafter, an example of a setting procedure will be described.

First, an object to be driven and a driving condition are checked. Here, a value of a load capacitor, a driving frequency band, a maximum driving voltage, or the like are checked.

Here, it is assumed that a value of the load capacitor $C_L$ is 5 nF, the driving frequency band is in a range of 40 to 80 kHz, and the driving voltage is 250 V.

Second, a self inductance of a secondary coil of a transformer is set.

The self inductance of the secondary coil of the transformer is set such that a resonance frequency (parallel resonance frequency) due to the load capacitor $C_L$ and the secondary coil of the transformer is located in a slightly lower band of the driving frequency band with respect to a center frequency. Alternatively, in the case of, for example, an ultrasonic speaker that is driven by a modulated wave (here, upper sideband is used), the self inductance of the secondary coil of the transformer is set such that a frequency of a carrier wave approximately matches the parallel resonance frequency.

Alternatively, the self inductance of the secondary coil of the transformer is set such that the parallel resonance frequency f2 shown in FIG. 4 approximately matches the frequency of the carrier wave.

Here, it is assumed that the ultrasonic speaker is driven at the carrier wave frequency of 40 kHz to 50 kHz and a secondary-side coil inductance of the output transformer T is 2 mH.

Third, a self inductance of a primary coil of the transformer is set (a voltage raising ratio of the transformer is set). The voltage raising ratio (gain, turn ratio) of the output transformer T is determined on the basis of the maximum driving voltage of the load capacitor $C_L$ and an output voltage (a primary-side voltage of the transformer) of a class-D power amplifier. Thus, the self inductance of the primary coil of the transformer is determined.

Here, the gain of the transformer is set to 10. As a result, the primary-side coil inductance of the transformer is 20 μH.

Fourth, coefficients of the LC filter are set. Circuit constants of the LC filter ($L_1$, $C_1$, and $L_2$) are set such that the series resonance frequency f3 becomes approximately a high-band-side cutoff frequency of the driving frequency band and the series resonance frequency f5 is located at a lower band side of the switching frequency band (located to be as distant from the switching frequency band of the class-D power amplifier toward the low band side as possible). The resonance frequencies f3 and f5 can be obtained on the basis of the above equation of '$A_n\omega^6+B_n\omega^4+C_n\omega^2+D_n=0$'.

Here, it is assumed that $L_1$=10 μH, $C_1$=0.18 μF, and $L_2$=10 μH. In addition, the leakage inductance $L_L$ is automatically determined at a time when specifications of coil and core of the transformer are determined. Here, it is assumed that the leakage inductance $L_L$ is 0.4 μH with a coupling coefficient of the transformer as 0.98.

Fifth, a value of the coupling capacitor $C_C$ is set. The value of the coupling capacitor $C_C$ is set such that gradient of a gain response in a frequency band between the series resonance frequencies f1 and f3 becomes small (approximates to a flat shape). Here, $C_C$ is set to 0.33 μF.

Sixth, a resistance value of the damping resistor $R_D$ is set. Finally, the resistance value of the damping resistor $R_D$ is set such that there is no peak within the frequency band between the frequencies f1 and f3 and a flat pass characteristic is obtained. Here, $R_D$ is set to 10Ω.

By the procedures described above, the circuit constants can be efficiently set.

Figure 5A:
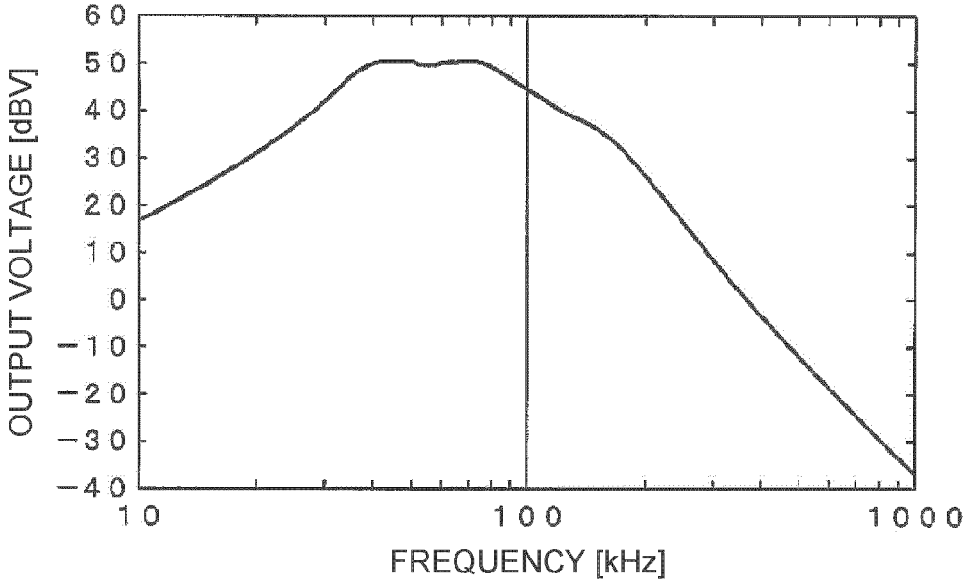
FIG. 5A is a view illustrating an example of a frequency characteristic of an output voltage.
Figure 5B:
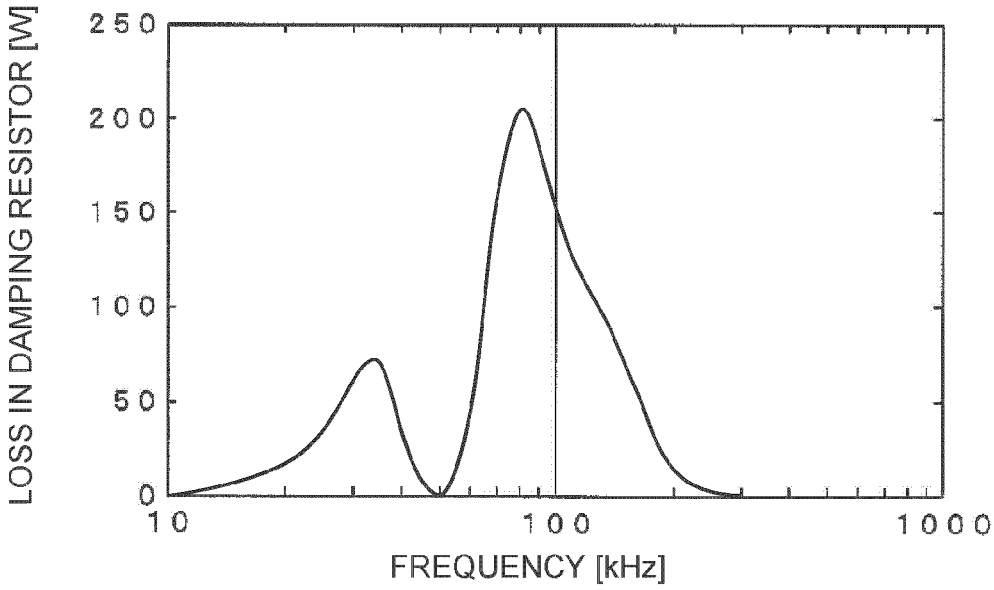
FIG. 5B is a view illustrating an example of a loss occurring in a damping resistor.

FIGS. 5A and 5B are views illustrating an example of a frequency characteristic of an output voltage and an example of a loss occurring in a damping resistor. By setting the circuit constants in the procedures described above, it is possible to obtain the frequency characteristic of the output voltage shown in FIG. 5A (the same figure as FIG. 2). As shown in FIG. 5A, a flat output characteristic with no peak can be obtained in the driving frequency band (40 kHz to 80 kHz), and a sufficient carrier attenuation characteristic can be obtained in a switching frequency band (equal to or larger than 500 kHz) of the class-D power amplifier.

FIG. 5B illustrates a loss occurring in the damping resistor $R_D$ on the assumption of the output characteristic shown in FIG. 5A, in the circuit shown in FIG. 1 (equivalent circuit shown in FIG. 3). A loss at the parallel resonance frequency f2 (about 50 kHz) of the circuit becomes extremely small.

As described above, in the embodiment of the invention, since a constant of each element of the output circuit is set such that the driving frequency band of the load is approximately equal to the parallel resonance frequency f2, it is possible to reduce a current flowing through the primary side of the transformer in the driving frequency band. As a result, the loss in the damping resistor $R_D$ can be reduced. In particular, in the case of driving the ultrasonic speaker, the circuit loss can be suppressed to be extremely small by setting a carrier frequency of the ultrasonic speaker to about 50 kHz in the example described above.

The driving circuit described above is suitable for being used as a driving circuit of an ultrasonic speaker that uses an electrostatic transducer. The ultrasonic speaker can reproduce a sound having high directionality by outputting a modulated wave obtained by modulating a carrier wave in an ultrasonic band with a sound signal in an audible band.

The electrostatic transducer has a relatively broad-band sound pressure/frequency characteristic. Accordingly, by using the electrostatic transducer as a transducer of an ultrasonic speaker, it is possible to improve the quality of a reproduced sound as compared with a narrow-band piezoelectric transducer.

Figure 6A:
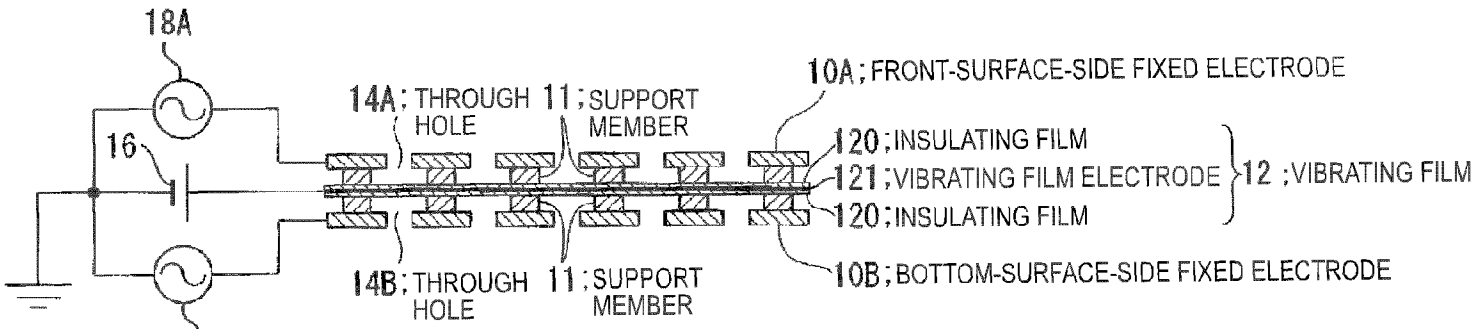
FIG. 6A is a view illustrating an example of the configuration of an electrostatic ultrasonic transducer.
Figure 6C:
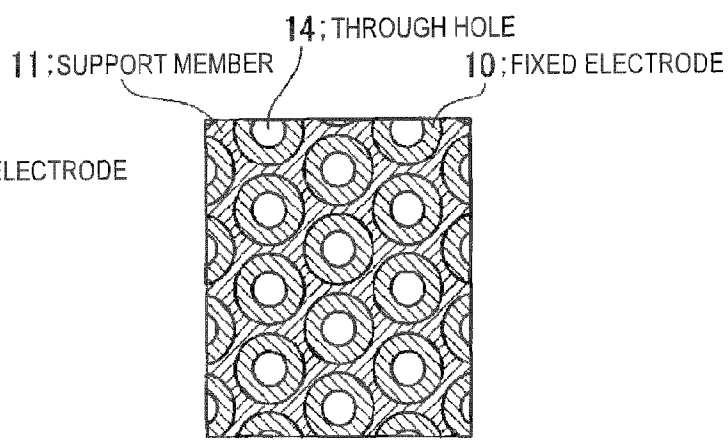
FIG. 6C is a view illustrating an example of the configuration of an electrostatic ultrasonic transducer.
Figure 6B:
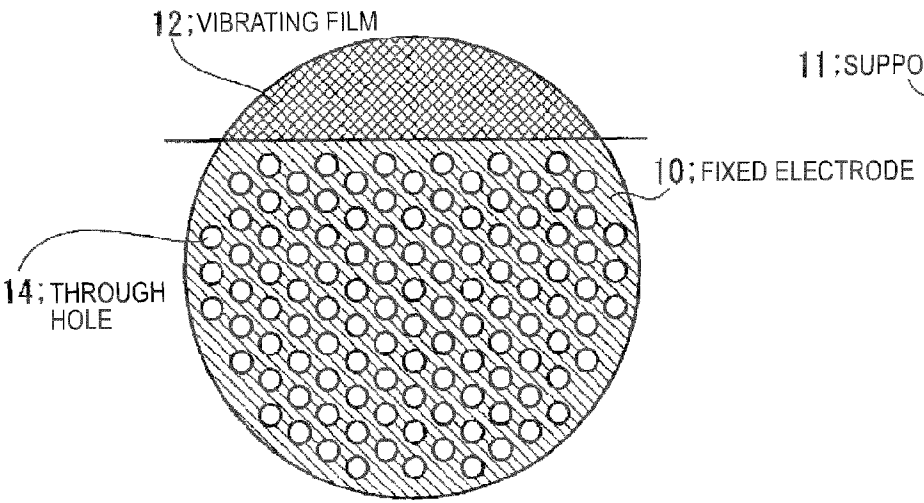
FIG. 6B is a view illustrating an example of the configuration of an electrostatic ultrasonic transducer.

FIGS. 6A, 6B, and 6C are views illustrating an example of the configuration of an electrostatic transducer suitable for being used in an ultrasonic speaker.

FIG. 6A illustrates a cross-sectional surface of an electrostatic transducer, and the electrostatic transducer includes: a vibrating film 12 having a conductive film (vibrating film electrode) 121; and a pair of fixed electrodes composed of a front-surface-side (first-surface-side) fixed electrode 10A and a bottom-surface-side (second-surface-side) fixed electrode 10B, each of which is provided opposite to each of the surfaces of the vibrating film 12 (in the case of indicating both the front-surface-side fixed electrode 10A and the bottom-surface-side fixed electrode 10B, it is called a fixed electrode 10). As shown in FIG. 6A, the vibrating film 12 may be formed by placing the conductive film (vibrating film electrode) 121 between insulating films 120 or the entire vibrating film 12 may be formed of a conductive material.

Furthermore, the front-surface-side fixed electrodes 10A that interleave the vibrating film therebetween are provided with a plurality of through holes 14A, and the bottom-surface-side fixed electrode 10B is provided with through holes 14B, each of which has the same shape and is located opposite to each of the through holes 14A provided in the front-surface-side fixed electrode 10A (in the case of indicating both the through hole 14A and the through hole 14B, it is called a through hole 14). The front-surface-side fixed electrodes 10A and the bottom-surface-side fixed electrodes 10B are supported by support members 11 with a predetermined gap between the vibrating film 12 and each of the front-surface-side fixed electrodes 10A and the bottom-surface-side fixed electrodes 10B. As shown in FIG. 6A, the support member is formed such that the vibrating film 12 and the fixed electrode 10 are opposite to each other through a gap therebetween. FIG. 6B illustrates an external appearance of a surface of a transducer in plan view (a state in which a part of the fixed electrodes 10 is notched), in which the plurality of through holes are arranged in a honeycomb shape. FIG. 6C is a plan view illustrating the fixed electrode to which the support member is attached, which shows a state in which the fixed electrode side is viewed from the vibrating film side of the transducer. The support member 11 is formed of an insulating material. For example, in such a manner of printing resist on a print substrate, the support member 11 may be formed by pattern-printing an insulating material on a surface (side opposite to the vibrating film) of the fixed electrode 10.

With the configuration described above, AC (alternating-current) signals 18A and 18B whose amplitudes are equal and phases are inverted with respect to each other are applied to the front-surface-side fixed electrodes 10A and the bottom-surface-side fixed electrodes 10B of the electrostatic transducer, respectively. In addition, a DC bias voltage is applied to the vibrating film electrode 121 by a DC power supply 16. Thus, by applying the DC bias voltage to the vibrating film electrode 121 and applying driving signals (AC signals), of which phases are inverted with respect to each other, to the front-surface-side fixed electrodes 10A and the bottom-surface-side fixed electrodes 10B, an electrostatic attraction force and an electrostatic repulsion force work on the vibrating film 12 simultaneously in the same direction. Whenever a polarity of the driving signal (AC signal) is inverted, the direction in which the electrostatic attraction force and the electrostatic repulsion force work is changed, and accordingly, the vibrating film 12 is push-pull driven. As a result, a sound wave occurring in the vibrating film is emitted to the outside through the through holes 14 provided in the front-surface-side fixed electrodes 10A and the bottom-surface-side fixed electrodes 10B.

Figure 7A:
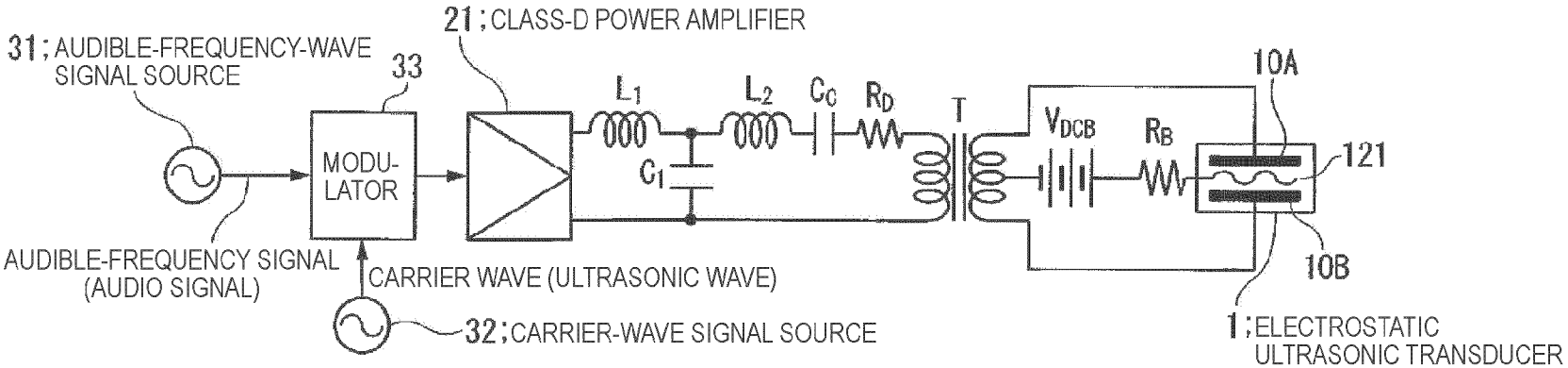
FIG. 7A is a view illustrating an example of the configuration of a driving circuit of an ultrasonic speaker.
Figure 7B:
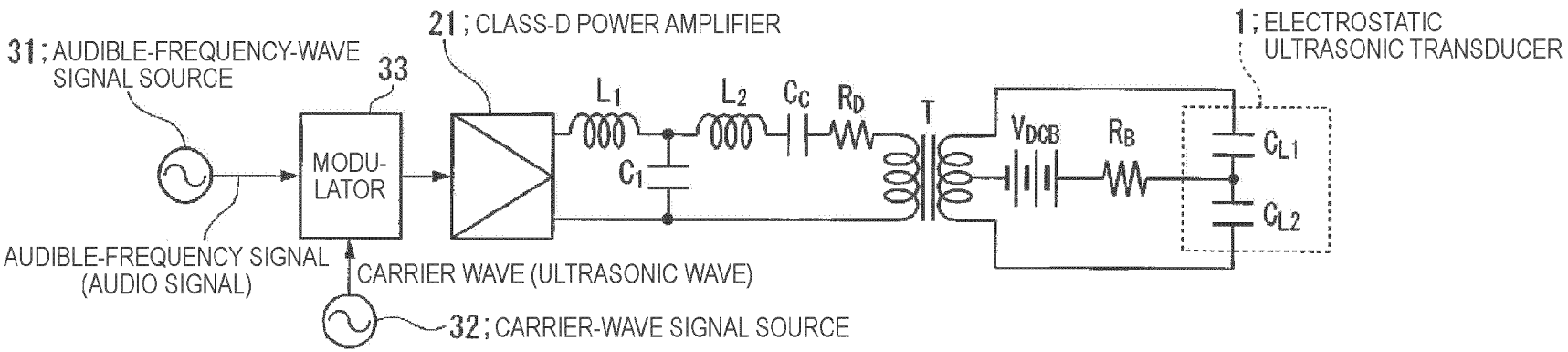
FIG. 7B is a view illustrating an example of the configuration of a driving circuit of an ultrasonic speaker.

FIGS. 7A and 7B are views illustrating an example of the configuration of a driving circuit of an ultrasonic speaker that uses an electrostatic transducer according to the embodiment of the invention. FIG. 7A is a view illustrating an example of the configuration of a driving circuit of an ultrasonic speaker that uses the electrostatic transducer shown in FIG. 6A. In addition, FIG. 7B is a view illustrating the electrostatic ultrasonic transducer (electrostatic transducer driven by a signal within an ultrasonic frequency band) 1 shown in FIG. 7A by using an equivalent circuit in which two load capacitors $C_{L1}$ and $C_{L2}$ are connected in series to each other, and a series connection point between the two load capacitors $C_{L1}$ and $C_{L2}$ corresponds to the vibrating film electrode 121.

The ultrasonic speaker shown in FIGS. 7A and 7B includes an audible-frequency-wave signal source (audio signal source) 31 that generates signal waves within an audible-wave frequency band, a carrier-wave signal source 32 that generates carrier waves within an ultrasonic frequency band, a modulator 33, and a class-D power amplifier 21, and the other reference numerals are denoted by using the same reference numerals as in FIG. 1.

In the ultrasonic speaker, an ultrasonic wave called a carrier wave is AM modulated with an audio signal (audible region signal) and then the AM-modulated ultrasonic wave is radiated to the air, and as a result, an original audio signal is self-reproduced in the air due to non-linearity of air. Specifically, the ultrasonic speaker is based on a principle in which the sound wave is a compressional wave that propagates by using air as a medium, the sound speed is fast in a dense part but slow in a sparse part due to a noticeable difference between the dense part and the sparse part of the air while a modulated ultrasonic wave is propagating which distorts the modulated wave, and as a result, the modulated ultrasonic wave is separated into a carrier wave (ultrasonic wave) and an audible wave (original audio signal) and human beings can hear only an audible sound (original audio signal) equal to or smaller than a frequency of 20 kHz. This principle is generally called a parametric array effect.

In the configuration described above, a carrier wave in an ultrasonic frequency band output from the carrier-wave signal source 32 is modulated with the audible frequency signal (audio signal) output from the audible-frequency-wave signal source 31 by using the modulator 33, and a modulated signal amplified in the class-D power amplifier 21 is applied to both ends of the primary coil of the output transformer T through $L_1$, $C_1$, $L_2$, $C_C$ and $R_D$. Thus, the electrostatic ultrasonic transducer 1 connected to the secondary coil of the output transformer T is driven.

Here, the configuration of the circuit shown in FIGS. 7A and 7B is different from that shown in FIG. 1 in that a center tap is provided in the secondary coil of the output transformer T and a DC bias voltage VDCB is applied to the vibrating film electrode 121 of the transducer by using the center tap as a reference. In addition, since a resistor $R_B$ is not directly related to the invention, the resistor $R_B$ may be omitted.

Since alternating voltages, of which amplitudes are equal and phases are inverted with respect to each other, are respectively applied to the front-surface-side fixed electrodes 10A and the bottom-surface-side fixed electrodes 10B by connecting the output transformer T to the electrostatic ultrasonic transducer 1 as shown in FIGS. 7A and 7B, it is possible to output a sound wave having a small amount of distortion.

In addition, a high pass filter is formed in the output circuit (serving to attenuate an audible frequency band). Accordingly, when outputting an AM modulated wave in an ultrasonic band from the electrostatic ultrasonic transducer 1, it is possible to prevent an audible frequency component from being distorted and being directly output from the transducer, that is, it is possible to suppress sound leak. As a result, it is possible to prevent the directionality of a reproduced sound from being lowered.

Hereinbefore, it has been described about the driving circuit of the electrostatic transducer according to the embodiment of the invention. In the driving circuit of the electrostatic transducer driven by the class-D power amplifier 21, the load capacitor $C_L$ is applied as a constituent element of the low pass filter, and the coupling capacitor $C_C$, the damping resistor $R_D$, and the output transformer T are inserted in the low pass filter (LC low pass filter). Thus, the driving circuit of the electrostatic transducer driven by the class-D power amplifier 21 has a characteristic of a BPF in terms of the entire circuit. This makes it possible to realize a flat output voltage frequency characteristic with no peak and to reduce a loss in a driving frequency band of the electrostatic transducer. Accordingly, since it is possible to reduce the loss in the entire driving circuit by reducing both a loss in a load resistor and a loss in an output-stage element of a power amplifier, the entire circuit including a load can be driven with high efficiency and the circuit size of the entire driving system can be reduced.

Further, even though the ultrasonic speaker has a characteristic in which a reproduced sound has high directionality, the entire output circuit has a characteristic of a BPF in the driving circuit according to the embodiment of the invention. Accordingly, it is possible to suppress an audible sound from being directly output (sound leak) from the ultrasonic speaker (electrostatic transducer) by setting the circuit constant such that an audible band is not included in a pass band of the circuit. As a result, it is also possible to obtain an effect in which it is possible to suppress the directionality of a reproduced sound from deteriorating due to the sound leak.

Furthermore, the driving circuit of the electrostatic transducer according to the embodiment of the invention can be applied to the overall driving of the capacitive load without being limited to the electrostatic transducer having the above-described configuration. For example, a method of designing the driving circuit according to the embodiment of the invention may be applied to a pull-type electrostatic transducer having a configuration in which fixed electrodes are arranged on only one surface of a vibrating film and only one side of the vibrating film is attracted, or the method may be applied to an ultrasonic transducer using a piezoelectric element.

Explanation on a Display Device Using an Electrostatic Transducer According to Another Embodiment of the Invention Next, it will be described about an example of a display device using an electrostatic ultrasonic transducer (hereinafter, also simply referred to as an 'ultrasonic transducer') that has the driving circuit of the electrostatic transducer according to the embodiment of the invention and is driven by a signal in an ultrasonic frequency band.

Figure 8:
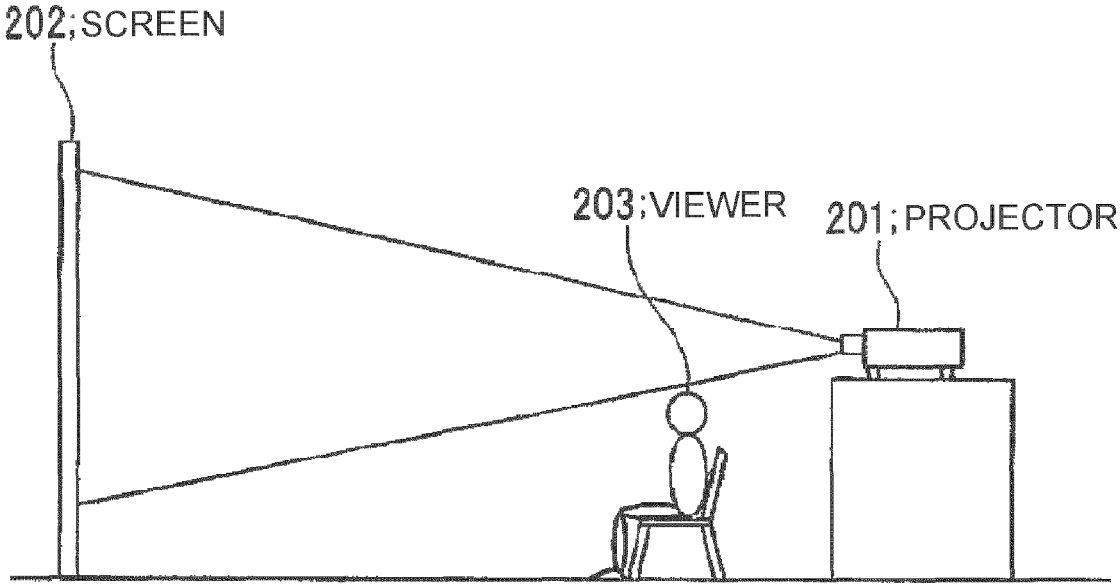
FIG. 8 is a view illustrating how a projector according to an embodiment of the invention is used.

FIG. 8 is a view illustrating an example of a display device, and a projector having an ultrasonic speaker is exemplified. Specifically, FIG. 8 shows how the projector is used. As shown in FIG. 8, a projector 201 is provided in a rear side of a viewer 203. In addition, the projector 201 is configured such that an image is projected onto a screen 202 provided in a front side of the viewer 203 and a virtual sound source is formed on a projection surface of the screen 202 by means of an ultrasonic speaker mounted in the projector 201, and thus a sound can be reproduced. In addition, a sound apparatus using an ultrasonic speaker that forms a virtual sound source on a projector screen or a projector having an ultrasonic speaker is called a directional sound system.

Figure 9A:
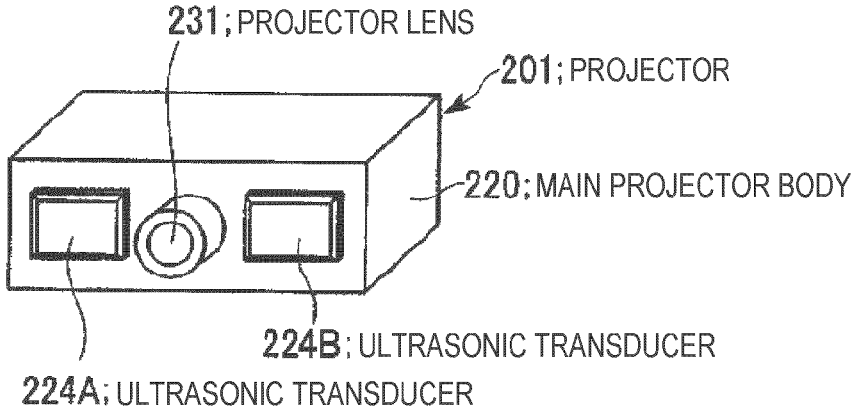
FIG. 9A is a view illustrating the outside configuration of the projector shown in FIG. 8.
Figure 9B:
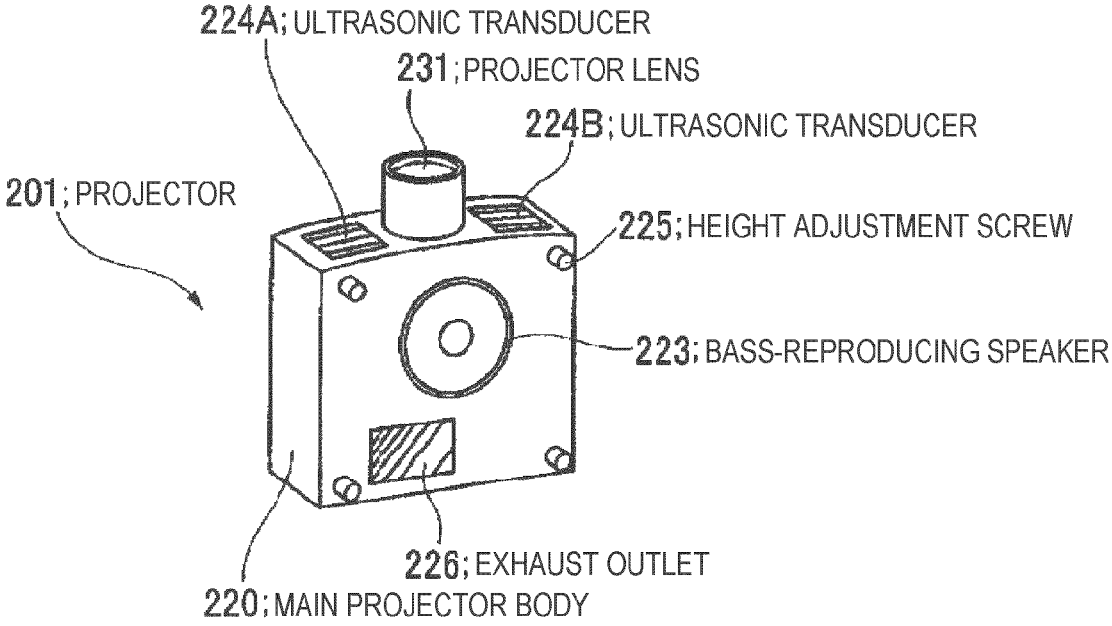
FIG. 9B is a view illustrating the outside configuration of the projector shown in FIG. 8.

An outside configuration of the projector 201 is shown in FIGS. 9A and 9B. The projector 201 is configured to include: a main projector body 220 having a projection optical system that projects an image onto a projection surface, such as a screen, and ultrasonic transducers 224A and 224B capable of generating sound waves in an ultrasonic frequency band. In addition, the projector 201 is integrally formed together with an ultrasonic speaker that reproduces signal sounds in an audible frequency band from sound signals supplied from the sound source. In the present embodiment, in order to reproduce a stereo sound signal, the electrostatic ultrasonic transducers 224A and 224B that form an ultrasonic speaker and are located on the left and right sides of a projector lens 231 forming the projection optical system are mounted in the main projector body.

In addition, a bass-reproducing speaker 223 is provided on a bottom surface of the main projector body 220. In addition, reference numeral 225 denotes a height adjustment screw used to adjust the height of the main projector body 220, and reference numeral 226 denotes an exhaust outlet for an air cooling fan.

Further, in the projector 201, an electrostatic ultrasonic transducer is used as an ultrasonic transducer forming the ultrasonic speaker. The electrostatic ultrasonic transducer is driven by a driving circuit including a class-D power amplifier, a filter, and a transformer. In addition, the electrostatic ultrasonic transducer is configured such that a flat output frequency characteristic is realized by the driving circuit and a loss in the entire driving circuit becomes small by reducing both the loss in the driving frequency band of the transducer and the loss in an output-stage element of the class-D power amplifier. Thus, a sound signal (sound wave in an ultrasonic frequency band) in a wide range of frequency band can oscillate with high sound pressure. In addition, by changing a frequency of a carrier wave so as to control a spatial reproduction range of a reproduced signal in an audible frequency band, it is possible to realize a sound effect, which can be obtained in a stereo surround system or 5.1 channel surround system, without a large-scale sound system that has been required in the related art, and to implement a projector that can be easily carried.

Figure 10:
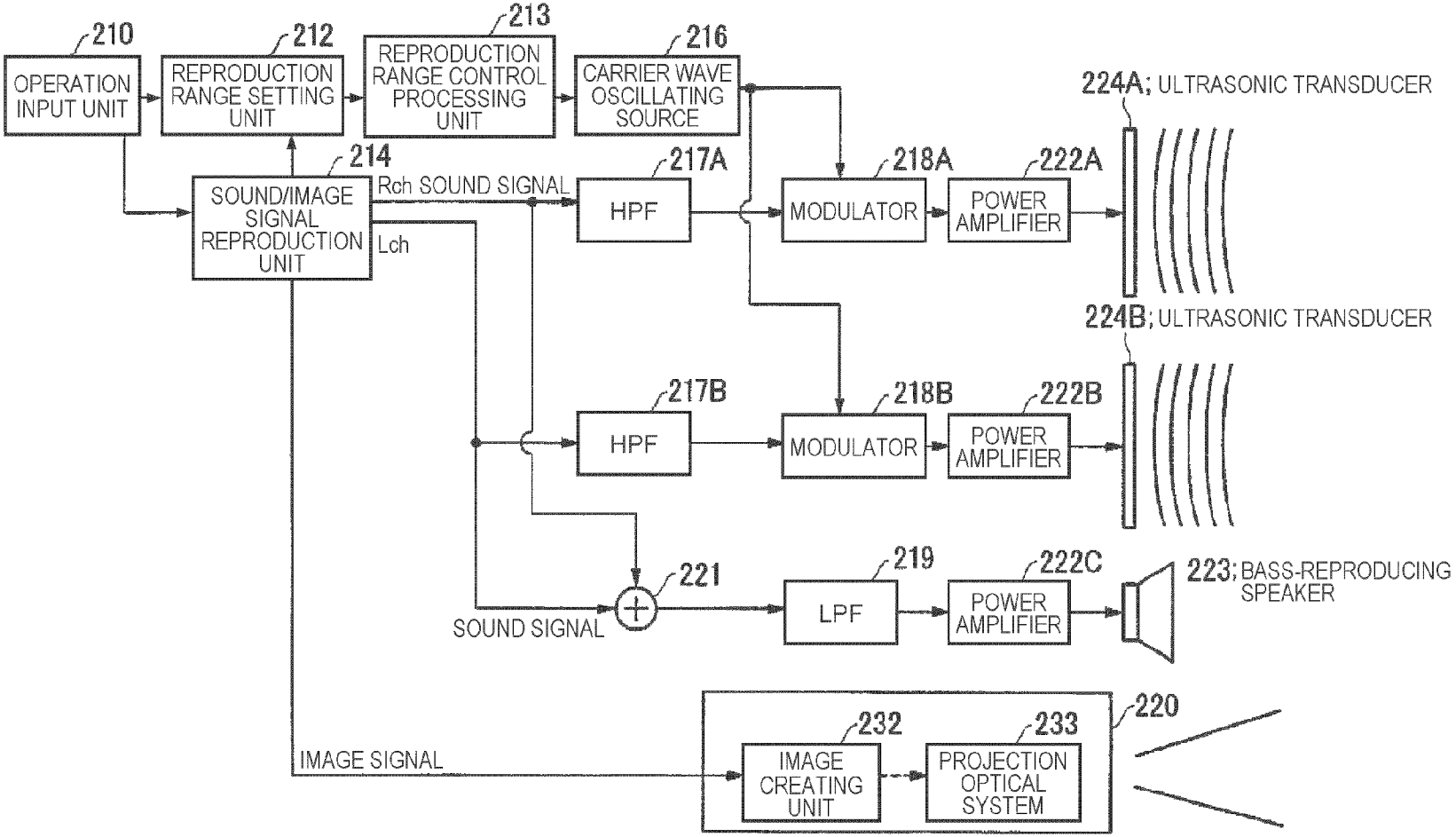
FIG. 10 is a view illustrating the electrical configuration of the projector shown in FIG. 8.

Next, an electrical configuration of the projector 201 is shown in FIG. 10. The projector 201 includes: an operation input unit 210; an ultrasonic speaker having a reproduction range setting unit 212, a reproduction range control processing unit 213, a sound/image signal reproduction unit 214, a carrier wave oscillating source 216, modulators 218A and 218B, driving circuit units 222A and 222B, electrostatic ultrasonic transducers 224A and 224B; high pass filters 217A and 217B; a low pass filter 219; a mixer 221; a power amplifier 222C; a bass-reproducing speaker 223; and a main projector body 220. In addition, the driving circuit units 222A and 222B are driving circuits of an electrostatic transducer, which is configured to include the class-D power amplifier 21, the LC filter, and the output transformer shown in FIG. 3.

The main projector body 220 includes an image creating unit 232 that creates an image and an projection optical system 233 that projects a created image onto a projection surface. As described above, the projector 201 is configured such that the ultrasonic speaker, the bass-reproducing speaker 223, and the main projector body 220 are integrally formed.

The operation input unit 210 includes various function keys having a ten key, a numeric key, and a power key used to power on/off. The reproduction range setting unit 212 is configured such that a user can input data specifying the reproduction range of a reproduced signal (signal sound) by operating a key of the operation input unit 210 and a frequency of a carrier wave specifying the reproduction range of the reproduced signal is set and held if the data is input. Setting the reproduction range of the reproduced signal is performed by specifying the distance by which the reproduced signal propagates from sound wave radiating surfaces of the ultrasonic transducers 224A and 224B in the radiation-axis direction.

In addition, the reproduction range setting unit 212 is configured such that the frequency of the carrier wave can be set by a control signal that is output from the sound/image signal reproduction unit 214 in correspondence with details of the image.

In addition, by referring to set details of the reproduction range setting unit 212, the reproduction range control processing unit 213 has a function of controlling the carrier wave oscillating source 216 such that the frequency of the carrier wave generated by the carrier wave oscillating source 216 is changed so as to be within the set reproduction range.

For example, in the case when the distance corresponding to the carrier wave frequency of 50 kHz is set as existing information of the reproduction range setting unit 212, the reproduction range control processing unit 213 makes a control such that the carrier wave oscillating source 216 oscillates with a frequency of 50 kHz.

The reproduction range control processing unit 213 has a storage unit in which a table indicating the relationship between the distance for specifying the reproduction range, by which the reproduced signal propagates from the sound wave radiating surfaces of the ultrasonic transducers 224A and 224B in the radiation-axis direction, and the frequency of the carrier wave is stored beforehand. Data of the table may be obtained by actually measuring the relationship between the frequency of the carrier wave and the propagation distance of the reproduced signal.

The reproduction range control processing unit 213 obtains a frequency of a carrier wave corresponding to the distance information set with reference to the table and controls the carrier wave oscillating source 216 so as to oscillate with the corresponding frequency, on the basis of the set details of the reproduction range setting unit 212.

The sound/image signal reproduction unit 214 is, for example, a DVD player that uses DVDs as image media. The sound/image signal reproduction unit 214 is configured such that an R-channel sound signal of the reproduced sound signals is output to the modulator 218A through the high pass filter 217A, an L-channel sound signal is output to the modulator 218B through the high pass filter 217B, and an image signal is output to the image creating unit 232 of the main projector body 220.

In addition, the R-channel sound signal and the L-channel sound signal output from the sound/image signal reproduction unit 214 are mixed by the mixer 221 and are then input to the power amplifier 222C through the low pass filter 219. The sound/image signal reproduction unit 214 corresponds to a sound source.

The high pass filters 217A and 217B cause only frequency components, which belong to middle and high sound range, among the R-channel and L-channel sound signals to pass therethrough, respectively, and the low pass filter causes only bass frequency components among the R-channel and L-channel sound signals to pass therethrough.

As a result, sound signals, which belong to the middle and high sound range, among the R-channel and L-channel sound signals are reproduced by the ultrasonic transducers 224A and 224B, respectively, and bass sound signals among the R-channel and L-channel sound signals are reproduced by the bass-reproducing speaker 223.

In addition, the sound/image signal reproduction unit 214 may be a reproduction apparatus that reproduces a video signal input from the outside, without being limited to the DVD player. Moreover, the sound/image signal reproduction unit 214 has a function of outputting a control signal instructing the reproduction range setting unit 212 of the reproduction range such that the reproduction range of the reproduced sound can be dynamically changed to obtain the sound effect corresponding to a scene of the reproduced image.

The carrier wave oscillating source 216 has a function of generating a carrier wave having a frequency in an ultrasonic frequency band instructed from the reproduction range setting unit 212 and then outputting the generated carrier wave to the modulators 218A and 218B.

The modulators 218A and 218B have a function of AM modulating the carrier waves, which are supplied from the carrier wave oscillating source 216, with sound signals in an audible frequency band output from the sound/image signal reproduction unit 214 and then outputting the modulated signals to the driving circuit units 222A and 222B, respectively.

The ultrasonic transducers 224A and 224B are driven by the modulated signals that are output from the modulators 218A and 218B through the driving circuit units 222A and 222B, respectively. In addition, the ultrasonic transducers 224A and 224B have a function of converting the modulated signal to a sound wave having a limited amplitude level and then radiating the converted signal into a medium so as to reproduce the signal sound (reproduced signal) in an audible frequency band.

The image creating unit 232 includes a display, such as a liquid crystal monitor or a plasma display panel (PDP) and a driving circuit that drives the corresponding display on the basis of an image signal output from the sound/image signal reproduction unit 214, and serves to create images obtainable from the image signals output from the sound/image signal reproduction unit 214.

The projection optical system 233 has a function of projecting the image displayed on the display onto a projection surface, such as a screen provided at the front side of the main projector body 220.

Next, an operation of the projector 201 having the configuration described above will be described. First, data (distance information) indicating a reproduction range of a reproduced signal, which is supplied from the operation input unit 210 by a user's key operation, is set in the reproduction range setting unit 212, and a reproduction instruction with respect to the sound/image signal reproduction unit 214 is made.

Then, the distance information specifying the reproduction range is set in the reproduction range setting unit 212, and the reproduction range control processing unit 213 is supplied with the distance information set in the reproduction range setting unit 212. Then, the reproduction range control processing unit 213 obtains a frequency of a carrier wave corresponding to the set distance information with reference to the table stored in the storage unit, which is included in the reproduction range control processing unit 213, and controls the carrier wave oscillating source 216 so as to generate a carrier wave having the corresponding frequency.

Then, the carrier wave oscillating source 216 generates the carrier wave having the frequency corresponding to the distance information set in the reproduction range setting unit 212 and then outputs the generated carrier wave to the modulators 218A and 218B.

In addition, the sound/image signal reproduction unit 214 outputs an R-channel sound signal of the reproduced sound signals to the modulator 218A through the high pass filter 217A, outputs an L-channel sound signal to the modulator 218B through the high pass filter 217B, outputs the R-channel sound signal and the L-channel sound signal to the mixer 221, and outputs an image signal to the image creating unit 232 of the main projector body 220.

As a result, a sound signal, which belongs to the middle and high sound range, among the R-channel sound signals is input to the modulator 218A through the high pass filter 217A and a sound signal, which belongs to the middle and high sound range, among the L-channel sound signals is input to the modulator 218B through the high pass filter 217B.

Then, the R-channel sound signal and the L-channel sound signal are mixed by the mixer 221, and then a bass sound signal of the R-channel sound signal and the L-channel sound signal is input to the power amplifier 222C through the low pass filter 219.

The image creating unit 232 creates and displays images by driving the display on the basis of input image signals. The image displayed on the display is projected onto a projection surface, for example, the screen 202 shown in FIG. 8 by means of the projection optical system 233.

On the other hand, the modulator 218A AM-modulates the carrier wave, which is output from the carrier wave oscillating source 216, with the sound signal, which belongs to the middle and high sound range, among the R-channel sound signals output from the high pass filter 217A and then outputs the AM modulated signal to the driving circuit unit 222A.

In addition, the modulator 218B AM-modulates the carrier wave, which is output from the carrier wave oscillating source 216, with the sound signal, which belongs to the middle and high sound range, among the L-channel sound signals output from the high pass filter 217B and then outputs the AM modulated signal to the driving circuit unit 222B.

The modulated signal amplified by the driving circuit unit 222A is applied between the front-surface-side fixed electrode (upper electrode) 10A and the bottom-surface-side fixed electrode (lower electrode) 10B of the ultrasonic transducer 224A and the modulated signal amplified by the driving circuit unit 222B is applied between the front-surface-side fixed electrode (upper electrode) 10A and the bottom-surface-side fixed electrode (lower electrode) 10B of the ultrasonic transducer 224B (refer to FIG. 6A). In addition, the modulated signal is converted to a sound wave (sound signal) having a limited amplitude level and is then radiated into a medium (air). In addition, the sound signal, which belongs to the middle and high sound range, among the R-channel sound signals is reproduced from the ultrasonic transducer 224A, and the sound signal, which belongs to the middle and high sound range, among the L-channel sound signals is reproduced from the ultrasonic transducer 224B.

In addition, the bass sound signals in the R-channel and the L-channel, which have been amplified by the power amplifier 222C, are reproduced by the bass-reproducing speaker 223.

As described above, in the propagation of an ultrasonic wave radiated into the medium (air) by the ultrasonic transducers, the sound speed is fast in a portion where the sound pressure is high but slow in a portion where the sound pressure is low as the ultrasonic wave propagates. As a result, the waveform is distorted.

In the case when radiating signals (carrier waves) in the ultrasonic frequency band are modulated (AM modulated) with signals in the audible frequency band, the signal waves in the audible frequency band used in the modulation are separated from the carrier waves in the ultrasonic frequency band due to a result of the waveform distortion, and then the signal waves in the audible frequency band are self-demodulated. At this time, the divergence of the reproduced signal leads to a beam shape due to the characteristic of an ultrasonic wave, and thus a sound is reproduced only in the specific direction, which is totally different from a typical speaker.

The beam-shaped reproduced signal, which is output from the ultrasonic transducers 224A and 224B included in the ultrasonic speaker, is radiated toward a projection surface (screen), onto which images are projected, by the projection optical system 233 and is then reflected from the projection surface to be diffused. In this case, depending on a frequency of a carrier wave set in the reproduction range setting unit 212, the distance until the reproduced signal is separated from the carrier wave and the beam width (diffusion angle of a beam) of the carrier wave vary in the radiation-axis direction (normal-line direction) from the sound wave radiating surfaces of the ultrasonic transducers 224A and 224B. As a result, the reproduction range varies.

Figure 11:
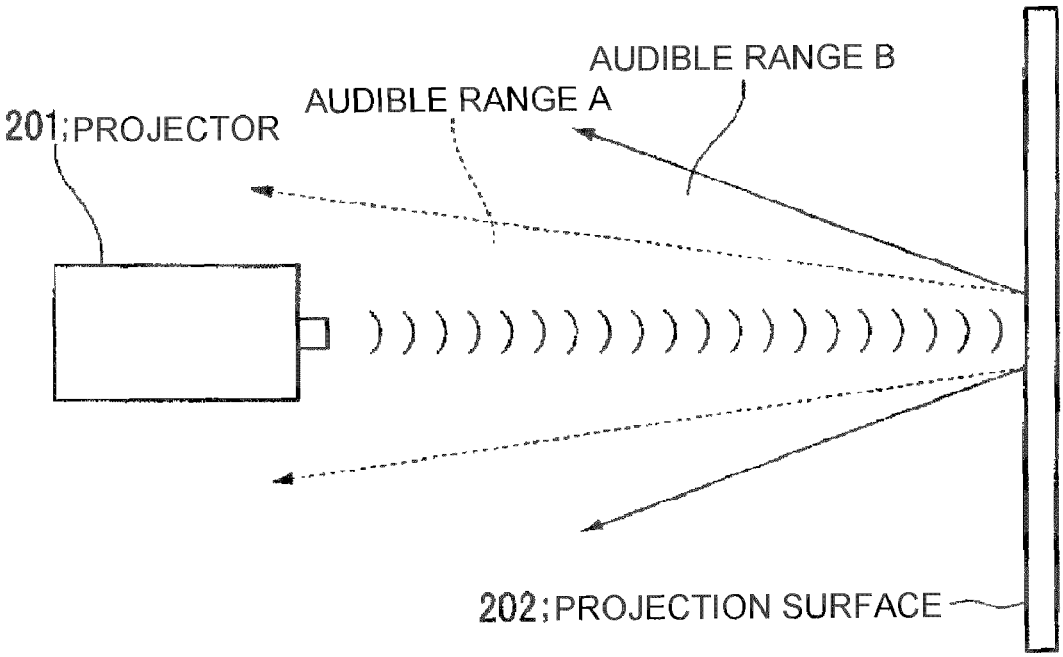
FIG. 11 is a view illustrating a state in which a reproduced signal is reproduced by an ultrasonic transducer.
Figure 12A:
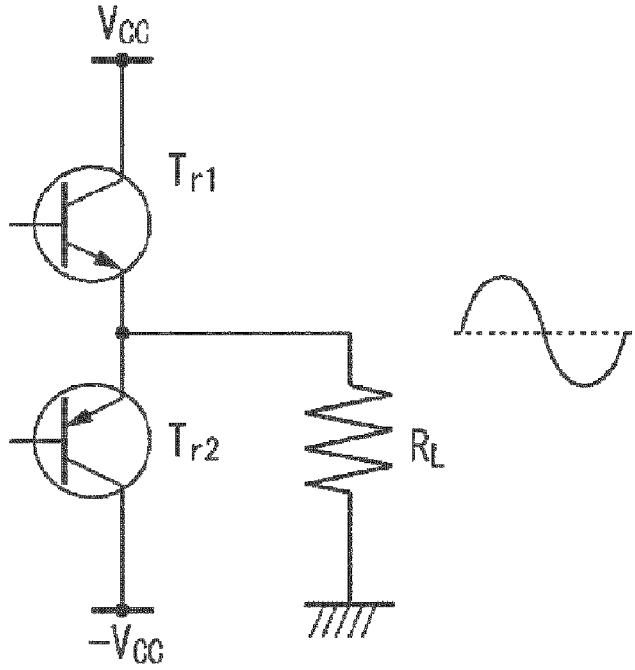
FIG. 12A is a view illustrating an example of a single end push-pull circuit.
Figure 12B:
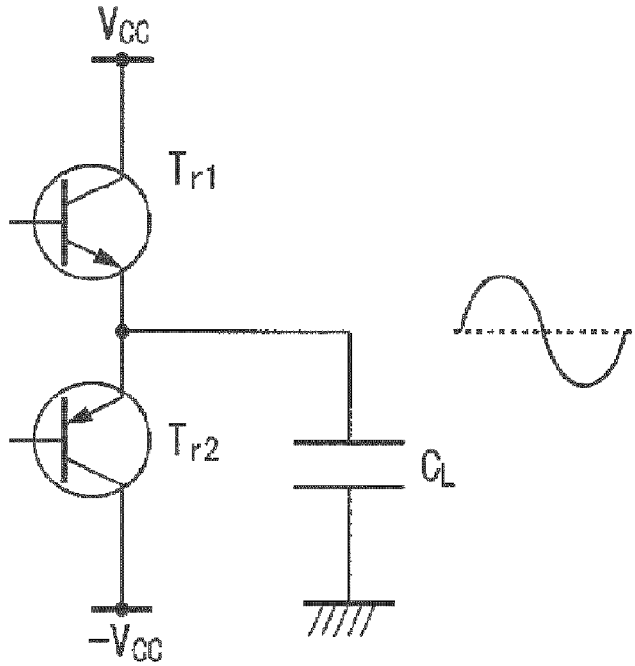
FIG. 12B is a view illustrating an example of a single end push-pull circuit.
Figure 13A:
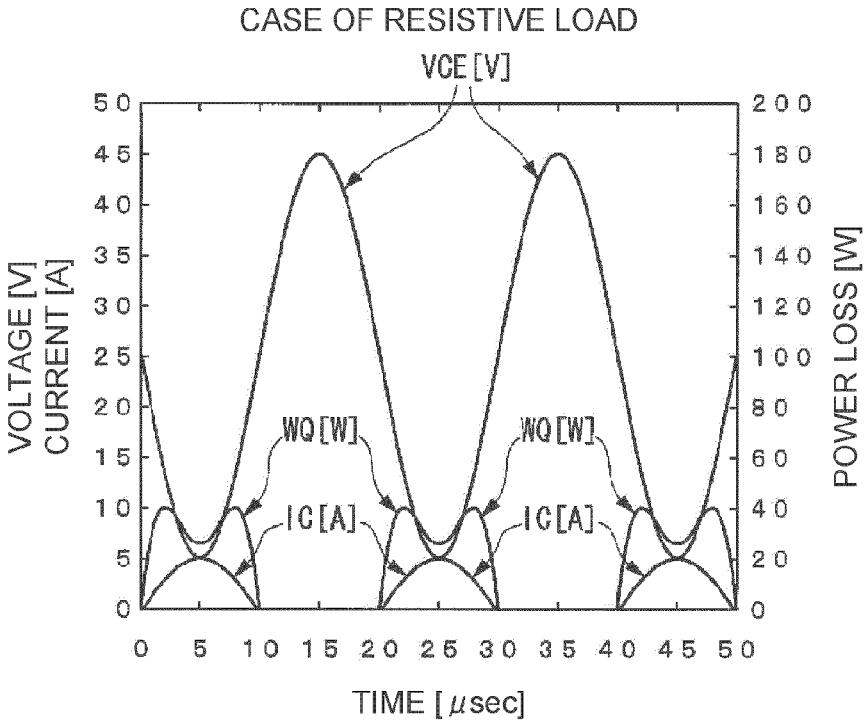
FIG. 13A is a view illustrating an example of a power loss occurring in an analog power amplifier.
Figure 13B:
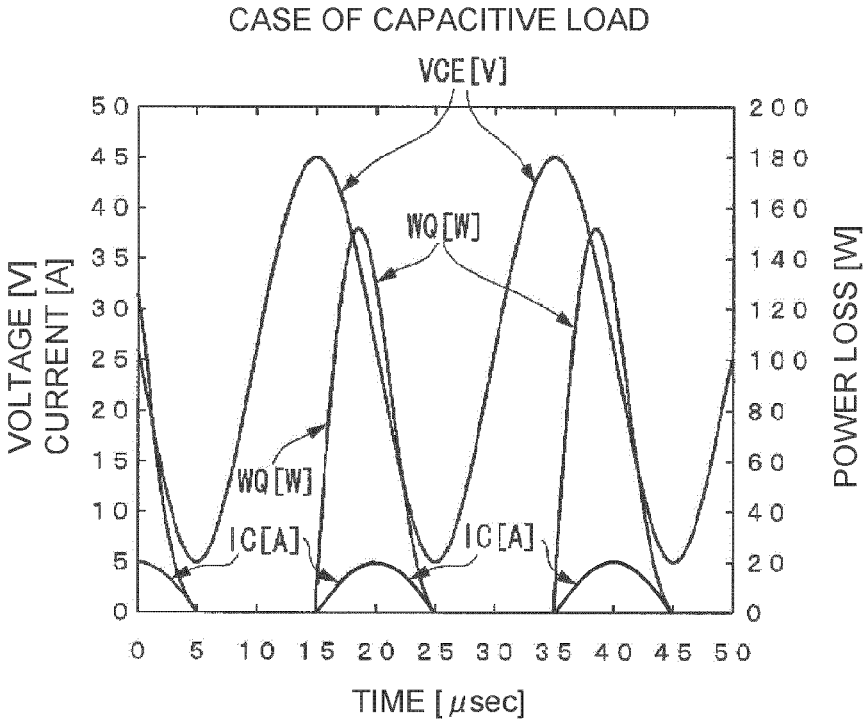
FIG. 13B is a view illustrating an example of a power loss occurring in an analog power amplifier.

FIG. 11 illustrates a state when reproducing the reproduced signal by means of the ultrasonic speaker, which includes the ultrasonic transducers 224A and 224B, in the projector 201. In the projector 201, when the ultrasonic transducer is driven by a modulated signal obtained by modulating a carrier wave with a sound signal, if a carrier frequency set by the reproduction range setting unit 212 is low, the distance until the reproduced signal is separated from the carrier wave in the radiation-axis direction (direction of a normal line of sound wave radiating surfaces) from the sound wave radiating surfaces of the ultrasonic transducers 224A and 224B, that is, a distance up to a reproduction point increases.

Accordingly, reproduced beams of the reproduced signal in the audible frequency band reach the projection surface (screen) 202 without being scattered over a relatively wide range. Then, the beams are reflected from the projection surface 202 under the state described above, and accordingly, the reproduction range becomes an audible range 'A' indicated by a dotted arrow in FIG. 11. As a result, the reproduced signal (reproduced sound) can be heard only in a range which is narrow and relatively far from the projection surface 202.

In contrast, in the case when the carrier frequency set by the reproduction range setting unit 212 is high, sound waves radiating from the sound wave radiating surfaces of the ultrasonic transducers 224A and 224B are scattered over a more wide range than in the case in which the carrier frequency is low; however, the distance until the reproduced signal is separated from the carrier wave in the radiation-axis direction (direction of a normal line of sound wave radiating surfaces) from the sound wave radiating surfaces of the ultrasonic transducers 224A and 224B, that is, the distance up to a reproduction point decreases.

Accordingly, reproduced beams of the reproduced signal in the audible frequency band reach the projection surface 202 while being scattered before reaching the projection surface 202. Then, the beams are reflected from the projection surface 202 under the state described above, and accordingly, the reproduction range becomes an audible range 'B' indicated by a solid arrow in FIG. 11. As a result, the reproduced signal (reproduced sound) can be heard only in a range which is wide and relatively close to the projection surface 202.

As described above, in the display device (for example, a projector) according to the embodiment of the invention, the ultrasonic speaker having the driving circuit of the electrostatic transducer according to the embodiment of the invention is used, and it is possible to drive the ultrasonic speaker with a low loss while obtaining a flat output frequency characteristic in a driving frequency band. Accordingly, it is possible to reproduce the sound signal that has a sufficient sound pressure and a wide-band characteristic and is generated from a virtual sound source formed around a sound wave reflecting surface, such as a screen. In addition, the control of the spatial reproduction range can be easily performed.

In addition, the above-described projector is used when a user desires to see images in a large screen; however, since a large-screen liquid crystal television or a large-screen plasma television has recently come into wide use, the ultrasonic speaker using the electrostatic transducer according to the embodiment of the invention can be efficiently applied to those large-screen televisions.

That is, by using the ultrasonic speaker in the large-screen televisions, the sound signal can radiate locally toward a front side of the large-screen television.

Having described about the embodiments of the invention, the electrostatic transducer, the ultrasonic speaker, and the display device according to the embodiments of the invention are not limited to examples described above, but various changes and modifications thereof could be made without departing from the spirit or scope of the invention.

The entire disclosure of Japanese Patent Application Nos: 2005-339779, filed Nov. 25, 2005 and 2006-230973, filed Aug. 28, 2006 are expressly incorporated by reverence herein.

What is claimed is:

1. An ultrasonic speaker comprising:

an electrostatic transducer driven by a signal in an ultrasonic frequency band, a modulator that supplies the electrostatic transducer with a modulated signal which is obtained by modulating a carrier wave signal in the ultrasonic frequency band with a sound signal in an audible frequency band, and the electrostatic transducer includes:

a class-D power amplifier that amplifies an input signal; and a low pass filter that has a plurality of pairs of inductors and capacitors, is connected to an output side of the class-D power amplifier, and serves to eliminate switching carrier components included in an output of the class-D power amplifier, a load capacitor of the electrostatic transducer serving as a driving load is disposed at a capacitor, which is closest to the output side of the low pass filter, of circuit elements forming the low pass filter, a coupling capacitor and an output transformer are interposed between the load capacitor of the electrostatic transducer and an inductor closest to the output side of the low pass filter, and a damping resistor is connected in series to a primary coil of the output transformer;

a first-surface-side fixed electrode formed with a plurality of holes;

a second-surface-side fixed electrode formed with a plurality of holes, the second-surface-side fixed electrode and the first-surface-side fixed electrode forming a pair; and a vibrating film that is interposed between the pair of fixed electrodes and has a conductive layer to which a DC bias voltage is applied, wherein a center tap is provided in a secondary coil of the output transformer, one end of the secondary coil of the output transformer is connected to the first-surface-side fixed electrode of the electrostatic transducer and the other end thereof is connected to the second-surface-side fixed electrode, and the DC bias voltage is applied to the conductive layer of the vibrating film by using the center tap of the secondary coil of the output transformer as a reference.

2. The ultrasonic speaker according to claim 1, wherein an output circuit of the electrostatic transducer, which includes the low pass filter, the coupling capacitor, the output transformer, and the load capacitor, is configured to have a first series resonance frequency f1, a second series resonance frequency f3, a third series resonance frequency f5, a first parallel resonance frequency f2, and a second parallel resonance frequency f4 as viewed from an input side of the low pass filter ($f1<f2<f3<f4<f5$), and wherein each circuit constant is set such that the first parallel resonance frequency f2 matches or approximately matches a carrier wave frequency or a rated driving frequency of the electrostatic transducer.

3. The ultrasonic speaker according to claim 2, wherein each circuit constant is set such that the second series resonance frequency f3 matches or approximately matches a cut-off frequency in a driving frequency band of the electrostatic transducer.

4. The ultrasonic speaker according to claim 1, wherein an output circuit of the electrostatic transducer, which includes the low pass filter, the coupling capacitor, the output transformer, and the load capacitor, is configured to have a first series resonance frequency f1, a second series resonance frequency f3, a third series resonance frequency f5, a first parallel resonance frequency f2, and a second parallel resonance frequency f4 as viewed from an input side of the low pass filter (f1<f2<f3<f4<f5), and wherein each circuit constant is set such that the second series resonance frequency f3 matches or approximately matches a cutoff frequency in a driving frequency band of the electrostatic transducer.

5. The ultrasonic speaker according to claim 1, wherein an output circuit of the electrostatic transducer, which includes the low pass filter, the coupling capacitor, the output transformer, and the load capacitor, is configured to have a first series resonance frequency f1, a second series resonance frequency f3, a third series resonance frequency f5, a first parallel resonance frequency f2, and a second parallel resonance frequency f4 as viewed from an input side of the low pass filter (f1<f2<f3<f4<f5), and wherein each circuit constant is set such that the third series resonance frequency f5 is positioned in a band lower than a switching frequency band at an output stage of the class-D power amplifier.

6. The ultrasonic speaker according to claim 1, wherein an output circuit of the electrostatic transducer, which includes the low pass filter, the coupling capacitor, the output transformer, and the load capacitor, is configured to have a first series resonance frequency f1, a second series resonance frequency f3, a third series resonance frequency f5, a first parallel resonance frequency f2, and a second parallel resonance frequency f4 as viewed from an input side of the low pass filter (f1<f2<f3<f4<f5), each circuit constant is set such that the first parallel resonance frequency f2 matches or approximately matches a carrier wave frequency or a rated driving frequency of the electrostatic transducer, and wherein each circuit constant is set such that the second series resonance frequency f3 matches or approximately matches a cutoff frequency in a driving frequency band of the electrostatic transducer.

7. The ultrasonic speaker according to claim 1, wherein an output circuit of the electrostatic transducer, which includes the low pass filter, the coupling capacitor, the output transformer, and the load capacitor, is configured to have a first series resonance frequency f1, a second series resonance frequency f3, a third series resonance frequency f5, a first parallel resonance frequency f2, and a second parallel resonance frequency f4 as viewed from an input side of the low pass filter (f1<f2<f3<f4<f5), each circuit constant is set such that the second series resonance frequency f3 matches or approximately matches a cutoff frequency in a driving frequency band of the electrostatic transducer, and wherein each circuit constant is set such that the third series resonance frequency f5 is positioned in a band lower than a switching frequency band at an output stage of the class-D power amplifier.

8. The ultrasonic speaker according to claim 1, wherein an output circuit of the electrostatic transducer, which includes the low pass filter, the coupling capacitor, the output transformer, and the load capacitor, is configured to have a first series resonance frequency f1, a second series resonance frequency f3, a third series resonance frequency f5, a first parallel resonance frequency f2, and a second parallel resonance frequency f4 as viewed from an input side of the low pass filter (f1<f2<f3<f4<f5), each circuit constant is set such that the first parallel resonance frequency f2 matches or approximately matches a carrier wave frequency or a rated driving frequency of the electrostatic transducer, each circuit constant is set such that the second series resonance frequency f3 matches or approximately matches a cutoff frequency in a driving frequency band of the electrostatic transducer, and wherein each circuit constant is set such that the third series resonance frequency f5 is positioned in a band lower than a switching frequency band at an output stage of the class-D power amplifier.

9. The ultrasonic speaker according to claim 1, wherein the low pass filter of the electrostatic transducer having the load capacitor is a fourth-order LC low pass filter.

10. The ultrasonic speaker according to claim 1, wherein the e ultrasonic speaker further comprises:

an audio frequency signal source which generates a signal wave in an audio frequency band; and a carrier wave signal source which generates and outputs a carrier wave in an ultrasonic frequency band to the modulator.

* * * * *